US005206131A

United States Patent [19]

Matsuda et al.

[11] Patent Number: 5,206,131

[45] Date of Patent: Apr. 27, 1993

[54] DIFFUSION TRANSFER TYPE SILVER HALIDE COLOR PHOTOSENSITIVE MATERIALS

[75] Inventors: Naoto Matsuda; Takeshi Nakamine; Koki Nakamura; Hiroyuki Hirai, all of Kanagawa, Japan

[73] Assignee: Fuji Photo Film Co., Ltd., Kanagawa, Japan

[21] Appl. No.: 683,913

[22] Filed: Apr. 11, 1991

[30] Foreign Application Priority Data

Apr. 12, 1990 [JP] Japan ..... 2-96756

[51] Int. Cl.[5] ..... G03C 5/54

[52] U.S. Cl. ..... 430/559; 430/203; 430/218; 430/219; 430/223; 430/957

[58] Field of Search ..... 430/203, 218, 219, 223, 430/544, 957, 559

[56] References Cited

U.S. PATENT DOCUMENTS

| | | | |
|---|---|---|---|
| 3,364,022 | 1/1968 | Barr | 430/219 |
| 3,639,417 | 2/1972 | Porter et al. | 430/957 |
| 4,629,683 | 12/1986 | Itoh et al. | 430/957 |
| 4,734,353 | 3/1988 | Ono et al. | 430/218 |
| 4,783,396 | 11/1988 | Nakamura et al. | 430/223 |

FOREIGN PATENT DOCUMENTS

| | | |
|---|---|---|
| 59-198453 | 11/1984 | Japan . |
| 2059092 | 4/1981 | United Kingdom . |

*Primary Examiner*—Richard L. Schilling
*Attorney, Agent, or Firm*—Sughrue, Mion, Zinn, Macpeak & Seas

[57] ABSTRACT

A diffusion transfer-type silver halide color photographic photosensitive material comprising a support, having thereon at least a photosensitive thermally developable silver halide, a binder, a dye donating compound which is fast to diffusion and which forms or releases a diffusible dye, a development inhibitor releasing compound which releases a development inhibitor and a compound represented by formula (I)

$$R^1—Y—O—H \qquad [I]$$

wherein $R^1$ represents an alkyl group, an aryl group, an alkylamino group, an arylamino group, an alkoxy group, an aryloxy group, a heterocyclic residual group or a polymer residual group of said groups, Y represents $$-\overset{O}{\overset{\|}{C}}-\overset{R^2}{\overset{|}{N}}-$$

or $—SO_2—NR^2—$ and $R^2$ represents a hydrogen atom, an alkyl group, an aryl group or an acyl group, and $R^1$ and $R^2$ may be joined together to form a five or eight membered ring is disclosed.

17 Claims, No Drawings

DIFFUSION TRANSFER TYPE SILVER HALIDE COLOR PHOTOSENSITIVE MATERIALS

FIELD OF THE INVENTION

The present invention concerns the improvement of color reproduction in diffusion transfer type color photographic photosensitive materials and more precisely it concerns diffusion transfer type silver halide photographic photosensitive materials in which color reproduction is improved by the release of development inhibitors.

BACKGROUND OF THE INVENTION

In those silver halide photographic photosensitive materials in which dye donating compounds form or release diffusible dyes by means of a reduction reaction, such as those disclosed, for example, in U.S. Pat. Nos. 4,199,354, 3,980,479, 4,139,379 and 4,783,396, used in methods of image formation involving diffusion transfer-type color photosensitive materials containing dye donating compounds which form or release diffusible dyes, a competitive reaction occurs between the silver halide reduction reaction and the reduction reaction of the compound which has diffusible dye donating properties used for image formation. The minimum density parts are formed by the silver halide and the reducing agent reacting at a higher rate than the reaction between the reducing agent and the diffusible dye donating compound. Consequently, the silver halide emulsion used must have a very high development rate. But development of unexposed silver halide (referred to hereinafter as development fogging) tends to occur readily with a further problem of a fall in color purity.

Furthermore, development fogging is also liable to occur as a result of high temperature processing with thermally developed diffusion transfer color photographic photosensitive materials. In this case, once again, a lowering of color purity is liable to occur. Methods in which development inhibitors are added to thermally developable silver halide photographic photosensitive materials in order to inhibit development fogging are known. Examples include those disclosed, for example, in JP-A-59-168442 (U.S. Pat. No. 4,500,627), JP-A-59-111636 (U.S. Pat. No. 4,614,702), JP-A-59-177550, JP-A-60-168545, JP-A-60-180199, JP-A-60-180563, JP-A-61-53633, JP-A-62-78554, JP-62-123456, JP-A-63-133144 and JP-A-2-44336. (The term "JP-A" as used herein signifies an "unexamined published Japanese patent application".) However, compounds which inhibit development fogging are generally adsorbed on silver halides and so there is competitive adsorption with the sensitizing dyes, which are similarly adsorbed on the silver halide, resulting in an undesirable loss of photographic speed. Known methods for overcoming this problem involve converting the development inhibitor to a precursor (a precursor of the development inhibitor) which is not adsorbed on the silver halide at the time of the exposure and inhibiting development fogging by releasing the inhibitor by the action of heat or alkali during development processing.

However, the release reaction rate is sometimes inadequate with these methods, or the release reaction does not take place efficiently because of side reactions. There also are cases in which the intended inhibition of development fogging does not occur effectively.

On the other hand, there are compounds which are generally known as compounds which release development inhibitors in accordance with the exposure in an imagewise manner. For example, there are the so-called DIR hydroquinones disclosed, for example, in U.S. Pat. Nos. 3,379,529, 3,620,746, 4,377,634 and 4,332,878; JP-A-56-153342, JP-A-49-129536 and JP-A-56-153336. The compounds generally emphasize development which has an effect between layers (the so-called lamination effect) during the development of silver halide photosensitive materials. The compounds are used with a view to improving color reproduction. However, the compounds also give rise to the same problems as the precursors of development fogging inhibitors described above. That is to say, the release of development inhibitor from the oxidized form of the DIR-hydroquinone is not rapid and does not occur efficiently. Thus it is impossible to realize a high efficiency. For this reason, there is a demand for a method by which development inhibitor is released at a satisfactory rate and with good efficiency in a heat developable silver halide photosensitive material.

A method for the fast and efficient release of development inhibitor has been disclosed in JP-A-59-198453, but its effect in diffusion transfer-type silver halide color photosensitive materials or heat developable diffusion transfer-type silver halide color photosensitive materials which contain dye donating compounds which form or release dyes by reduction is unknown.

Furthermore, it is difficult to increase the concentration of base to an extent that provides a satisfactory release rate in heat developable silver halide photosensitive materials in a method in which a base is produced during the development of the photosensitive material, without supplying base to the reaction. Hence, a method which provides a satisfactory release rate and release efficiency even with a low base concentration is especially desirable for obtaining good color reproduction.

It is impossible to improve color reproduction satisfactorily in diffusion transfer-type silver halide color photosensitive materials, especially diffusion transfer-type silver halide color photosensitive materials which contain dye donating compounds which form or release diffusible dyes as a result of reduction because emulsions which fog easily are often used. The present invention is intended to overcome the problems outlined above and provide diffusion transfer-type silver halide color photographic photosensitive materials which have good color reproduction.

SUMMARY OF THE INVENTION

As a result of thorough research, the inventors have discovered that a greater than expected improvement in color reproduction can be realized by the conjoint use of compounds which can be represented by the general formula [I] indicated below with development inhibitor releasing compounds that release development inhibitors.

Thus, the details of the invention are as described below.

a diffusion transfer-type silver halide color photographic photosensitive material comprising a support, having thereon at least photosensitive silver halide, binder, a non-diffusible dye donating compound which forms or releases a diffusible dye, development inhibitor releasing compound which releases a development inhibitor and a compound represented by formula (I):

$$R^1-Y-O-H \quad (I)$$

In the formula, $R^1$ represents an alkyl group, an aryl group, an alkylamino group, an arylamino group, an alkoxy group, an aryloxy group, a heterocyclic residual group or a polymer residual group of these groups.

Y represents

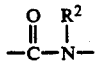

or $-SO_2-NR^2-$ wherein $R^2$ represents a hydrogen atom, an alkyl group, an aryl group or an acyl group. Furthermore, $R^1$ and $R^2$ may be joined together to form a five to eight membered ring.

DETAILED DESCRIPTION OF THE INVENTION

Examples of groups $R^1$, $R^2$, and Y are described below.

Examples of $R^1$ include alkyl groups (including those which have substituent groups, for example methyl, ethyl, sec-butyl, tert-octyl, benzyl, cyclohexyl, chloromethyl, dimethylaminomethyl, n-heptyl, n-undecyl, n-pentadecyl, n-hexadecyl, n-heptadecyl, trifluoromethyl, 3,3,3-trichloropropyl and methoxycarbonylmethyl), aryl groups (including those which have substituent groups, for example phenyl, naphthyl, 3-sulfophenyl, 4-methoxyphenyl and 3-lauroylaminophenyl), alkylamino groups (including those which have substituent groups, for example methylamino, diethylamino, and methyloctadecylamino), arylamino groups (including those which have substituent groups, for example phenylamino, p-ethylphenylamino and 3-tetradecylsulfamoylphenylamino), alkoxy groups (including those which have substituent groups, for example methoxy, ethoxy, dodecyloxy and benzyloxy), aryloxy groups (including those which have substituent groups, for example phenoxy, 4-methoxyphenoxy, 3-acetylaminophenoxy), and heterocyclic residual groups (including those which have substituent groups, for example, 2-pyridyl, 1-imidazolyl, benzothiazol-2-yl, morpholino and benzooxazol-2-yl).

Furthermore, the groups may be the ends of groups which are bonded in pendant form to a polymer, and these polymer residual groups include polyethylene residual groups, poly(vinyl alcohol) residual groups, polystyrene residual groups, poly(acrylic acid) residual groups and residual groups of poly(acrylic acid esters), polyacrylamide residual groups, and copolymers of these materials.

Examples of $R^2$ include hydrogen atoms, alkyl groups, (the same as those described for $R^1$), aryl groups (the same as those described for $R^1$), and arylacyl groups and alkylacyl groups (including those which have substituent groups, for example benzoyl, p-octyloxybenzoyl, propionyl, decanoyl, and octadecanoyl).

Compounds of general formula (I) which can be represented by the general formula (I') indicated below are preferred.

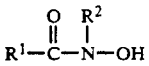

(I')

In this formula, $R^1$ represents an alkyl group, an aryl group or a heterocyclic residual group.

$R^2$ represents an alkyl group or an aryl group. $R^1$ and $R^2$ may be joined together to form a five to eight membered ring.

Actual examples of these groups are the same as those described in connection with general formula (I) respectively. From among these groups, the alkyl groups, which may be substituted, are preferred for $R^1$ and $R^2$.

Actual examples of compounds represented by general formula [I] which can be used in the invention are set forth below, but the invention is not limited by these actual examples.

Actual Examples of Compounds

| | Compound |
|---|---|
| I-1 | 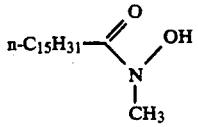 |
| I-2 | 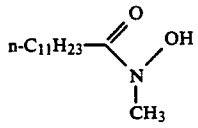 |
| I-3 | 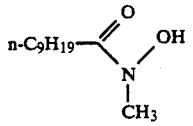 |
| I-4 | 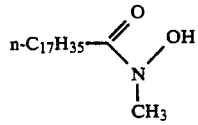 |
| I-5 | 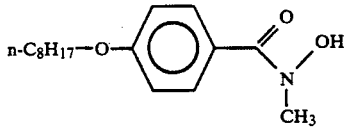 |
| I-6 | 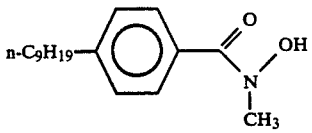 |
| I-7 | 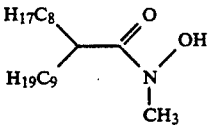 |
| I-8 | 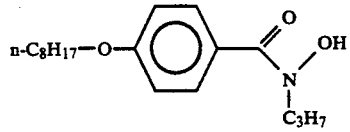 |
| I-9 | 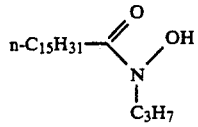 |

-continued
Actual Examples of Compounds
| | Compound |
|---|---|
| I-10 | 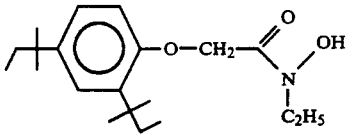 |
| I-11 | 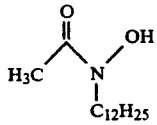 |
| I-12 | 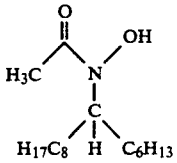 |
| I-13 | 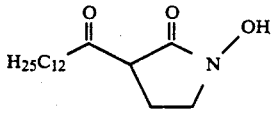 |
| I-14 | 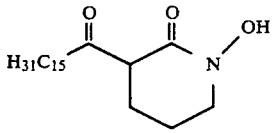 |
| I-15 | 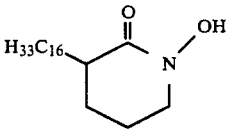 |
| I-16 | 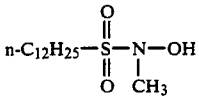 |
| I-17 | 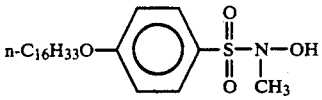 |
| I-18 | 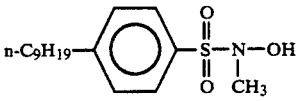 |
| I-19 | 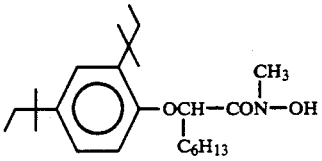 |
| I-20 | 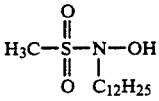 |
-continued
Actual Examples of Compounds
| | Compound |
|---|---|
| I-21 | 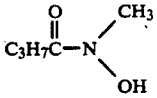 |
| I-22 | 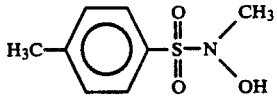 |
| I-23 | 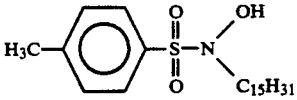 |
| I-24 | 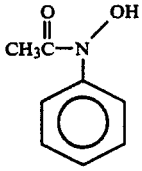 |
| I-25 | 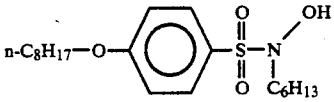 |
| I-26 | 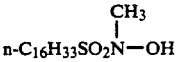 |
| I-27 | 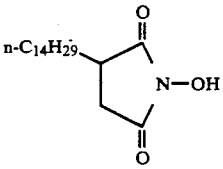 |
| I-28 | 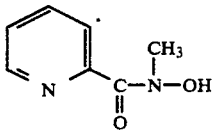 |
| I-29 | 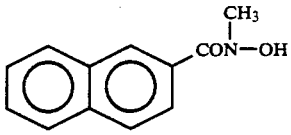 |
| I-30 | 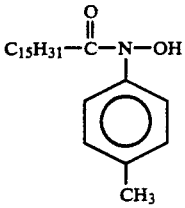 |
| I-31 | 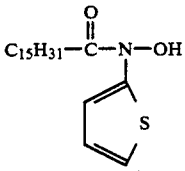 |

-continued

| Actual Examples of Compounds | Compound |
|---|---|
| I-32 | 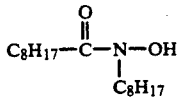 |
| I-33 | 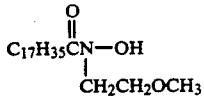 |
| I-34 | 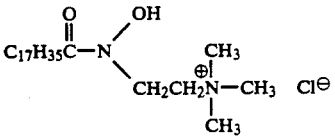 |
| I-35 | 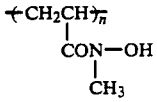 (n = 10~10,000) |
| I-36 | 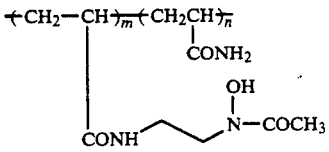 m and n represent 10 to 10,000 |
| I-37 | 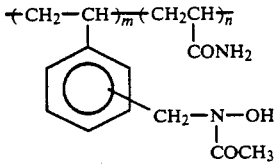 m and n are as defined above |
| I-38 | 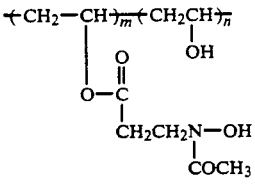 m and n are as defined above |

Methods for the preparation of compounds which can be represented by general formula (I) are described below.

Compounds of general formula (I) can be prepared easily by way of a dehydrohalogenation reaction of a carbonyl halide or a sulfonyl halide and hydroxylamines. They can also be prepared by means of an alcohol elimination reaction using an ester instead of a carbonyl halide. Furthermore, the N-hydroxyimides can be prepared by reaction with an alcohol after condensing hydroxamic acid and an acyl halide to form a triacyl compound.

More precisely, compounds which can be represented by general formula (I) of this present invention can be prepared principally using the two methods described below.

Method of Preparation (A)

A base is added to the appropriate ketoxime or aldoxime and then an alkylating agent such as a sulfuric acid ester, p-toluenesulfonic acid ester or alkyl halide, for example, is added and the nitrogen atom is alkylated whereupon an intermediate known as a nitrone generally is formed. Next, acid is added and the nitrone is hydrolyzed whereupon an N-alkylhydroxylamine is obtained. The solution containing the N-alkylhydroxylamine is neutralized and then, on reacting with an acid halide in the presence of a base, the target compound is obtained.

Method of Preparation (B)

Water is added to a commercial N-alkylhydroxylamine or an N-arylhydroxylamine obtained by reducing an aromatic nitro compound with zinc/ammonium chloride and an N-alkyl or aryl hydroxamic acid is obtained by reaction with an acid halide in the presence of a base.

Desirable results are obtained when, on adding the acid halide in either method (A) or method (B), the reaction is carried out in a water/organic solvent two-layer system at a temperature of 0°-15° C. and on carrying out the reaction in the presence of an inorganic base.

Examples of the preparation of actual compounds which can be used in this present invention are indicated below.

Preparation of Actual Illustrative Compound I-1

Water (3 liters) was added to 1000 grams of aldoxime and the mixture was agitated while being ice cooled. Sodium hydroxide (600 grams) was added slowly and after forming uniform solution, 1420 ml of dimethyl sulfate was added dropwise while maintaining a temperature of 20°-25° C.

Upon completion of dimethyl sulfate addition, the mixture was mixed for 3 hours. Two and a half liters of concentrated hydrochloric acid was added and the mixture was agitated for 4 hours at 70°-80° C. After cooling, 70 liters of water and 20 kg of ice were added to dilute the mixture and then 6 kg of sodium bicarbonate were added. After forming a uniform solution, 22 liters of ethyl acetate were added and 1620 grams of palmitoyl chloride were added dropwise with vigorous agitation at a temperature of from 0°-5° C. After the drip feed had been completed, the temperature was raised to 20° C. and the mixture was agitated for 1 hour after which 3 liters of concentrated hydrochloric acid were added slowly. Then, 50 liters of dichloromethane were added. The product was extracted and after drying the extract over magnesium sulfate, the solvent was removed under reduced pressure. Methanol (4 liters) was added to the crude crystals and the crystals were recrystallized yielding the target compound. Recovery: 626 grams, Yield: 37%, Melting point: 62° C.

Preparation of Actual Compound I-5

Water (40 ml) was added to 15 grams of N-methylhydroxylamine hydrochloride and a solution was obtained. Sodium carbonate (50 grams) was added, with ice cooling, and then 100 ml of ethyl acetate were added. Next, 4-octyloxybenzoyl chloride (38 grams) then was added dropwise with vigorous agitation while maintaining the temperature below 5° C. After the drip feed had been completed, the mixture was agitated for 30 minutes at 20° C. and then 10 ml of concentrated hydrochloric acid were added slowly, after which 300 ml of dichloromethane were added and the product was extracted. The extract was dried over magnesium sulfate and crude crystals were obtained on distilling off the solvent under reduced pressure. Then n-hexane (100 ml) was added and the crude crystals were recrystallized, yielding the target compound. Recovery: 33 grams, Yield: 82%, Melting point: 67° C.

The development inhibitor releasing compounds which are used in this present invention are described below.

The development inhibitor releasing compounds are of two types, namely those which release a development inhibitor on degradation by alkali or heat and those which release development inhibitors as a function of development. The compounds represented by formula (I) may be used in combination with either type of the development inhibitor agents. However, the combination use of those which release a development inhibitor as a function of development are preferred for improving color reproduction and for realizing to the full the effect of the compound represented by formula (I) of this present invention.

Development inhibitor precursors have been disclosed, for example, in JP-A-56-77842, JP-A-59-2012057, JP-A-61-43739 and JP-A-1-245255, and compounds which release development inhibitors as a function of development are known in U.S. Pat. Nos. 3,379,529, 3,620,746, 4,377,634 and 4,332,878, JP-A-56-153342, JP-A-49-129536 and JP-A-56-153336, and reference can be made to these citations in connection with methods for the preparation of these compounds.

Actual examples are indicated below, but the development inhibitor releasing compounds which can be used in this invention are not limited to these actual examples.

II-1

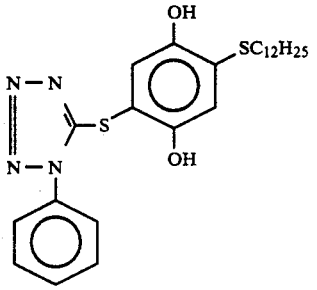

II-2

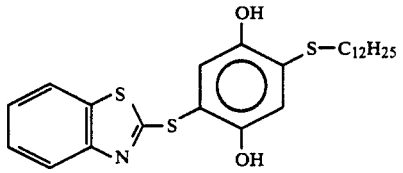

II-3

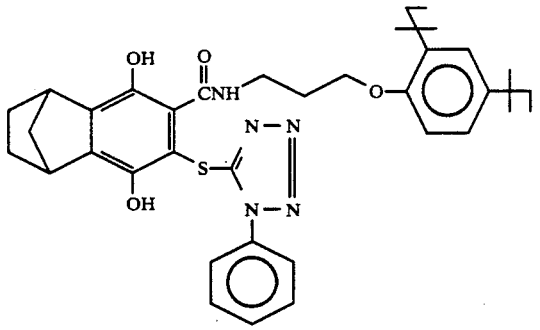

II-4

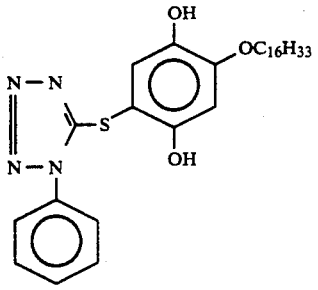

-continued
II-5
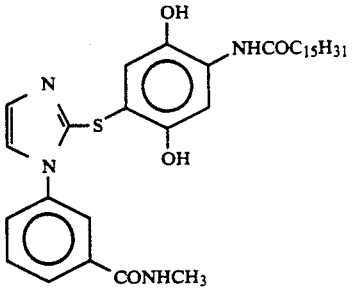
II-6
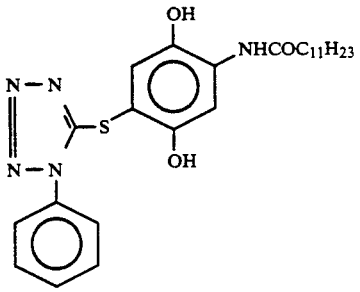
II-7
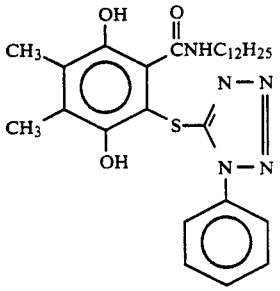
II-8
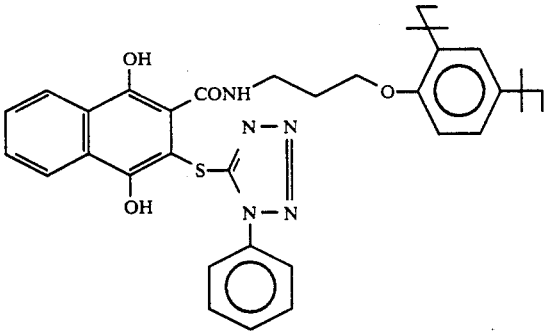
II-9
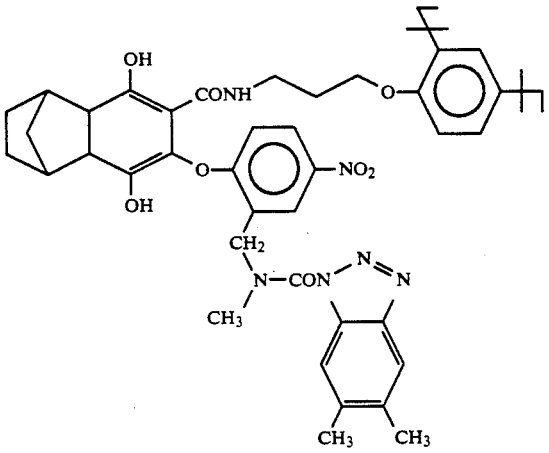

-continued
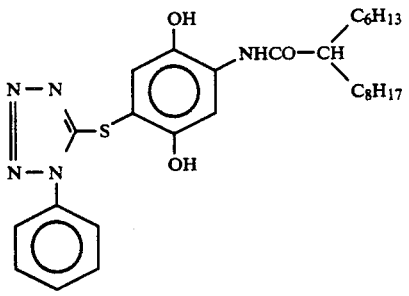
II-10
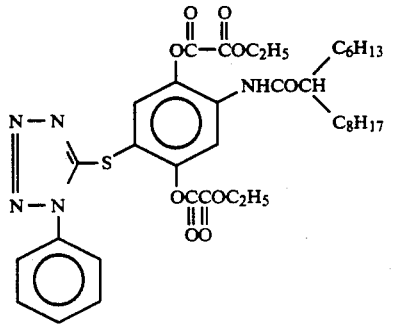
II-11
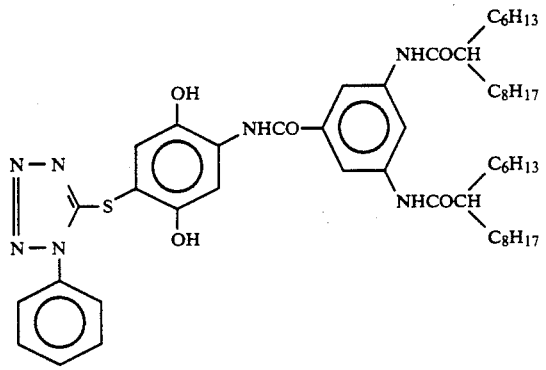
II-12
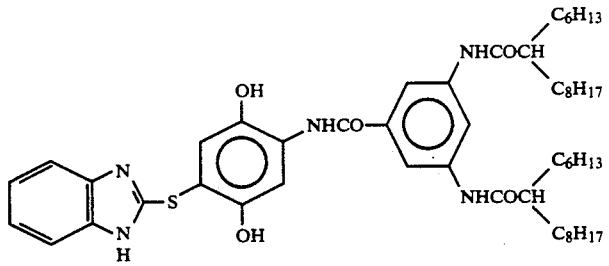
II-13
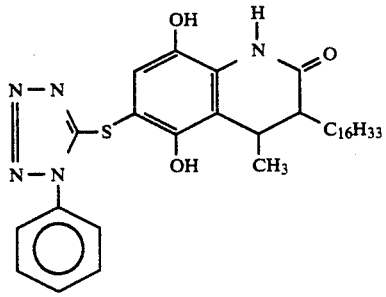
II-14

-continued
II-15
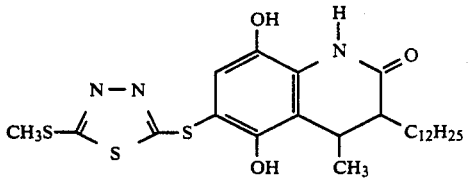
II-16
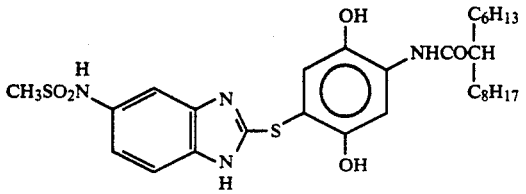
II-17
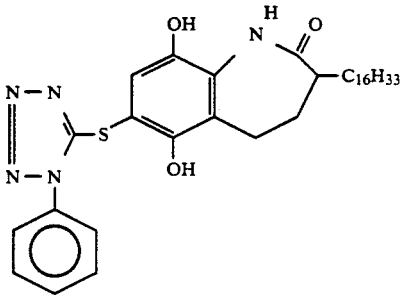
II-18
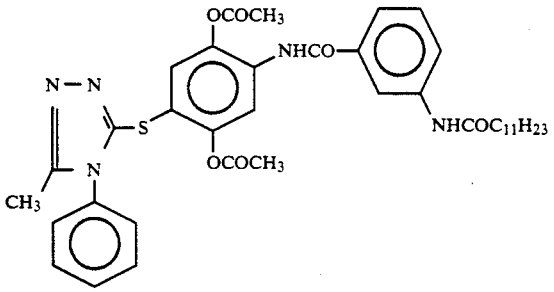
II-19
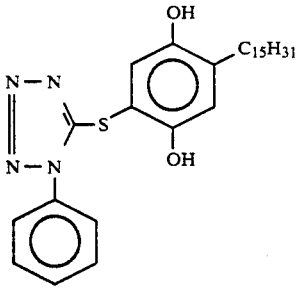
II-20
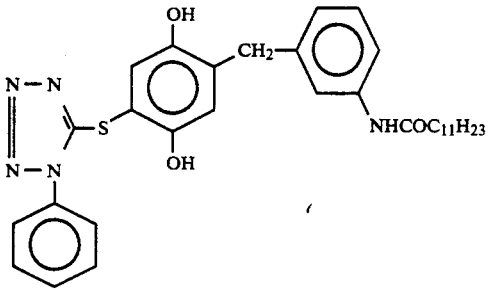
The development inhibitor releasing compounds of the present invention described above which is one of the essential components may be used in a layer which contains a non-diffusible dye donating compound which donates a diffusible dye, in a photosensitive layer, in an intermediate layer, a protective layer or in some other auxiliary layer. However, in photosensitive materials in which non-diffusible dye donors which donate diffusible dyes are used, the inhibitor releasing compounds are preferably added to a separate layer from the said dye donor.

The amount added is from 0.001 to 5 mol, and preferably from 0.01 to 1.5 mol, per mol of silver halide, and from 0.005 to 10 mol, and preferably from 0.02 to 1 mol, per mol of compound which forms or releases a diffusible dye.

The compounds of general formula (I) of the present invention are added in amounts of from 0.01 to 100 mol, and preferably of from 0.1 to 20 mol, per mol of development inhibitor releasing compound. They may be used in a photosensitive layer, in a layer which contains a dye donating compound, an intermediate layer, a protective layer or some other type of auxiliary layer. The compound of formula (I) is preferably added to the intermediate layer in which the development inhibitor releasing compound is added.

A photosensitive material of the present invention has essentially on a support a photosensitive silver halide and a diffusible dye donating compound. Various additives such as reducing agents, for example, can be used as required. The components are often added to the same layer but if they may react can be added separately to different layers. For example, loss of photographic speed is prevented if a colored diffusible dye donating compound is present in a layer below the silver halide emulsion.

A combination of at least three silver halide emulsion layers which are photosensitive to different spectral regions is used to obtain a wide range of colors in the chromaticity table using the three primary colors yellow, magenta and cyan. For example, three layer combinations consisting of a blue sensitive layer, a green sensitive layer and a red sensitive layer, and combinations of a green sensitive layer, a red sensitive layer and an infrared sensitive layer can be used. Various known arrangements and orders can be adopted for the photosensitive layers. Furthermore, each photosensitive layer can be divided into two or more layers, as required.

Various auxiliary layers, such as protective layers, under-layers, intermediate layers, yellow filter layers, anti-halation layers, backing layers, neutralizing layers, timing layers and peeling layers, for example, can be established in the photosensitive material.

All of the silver halides, namely silver chloride, silver bromide, silver iodobromide, silver chlorobromide, silver chloroiodide and silver chloroiodobromide, can be used in this present invention.

The silver halide emulsions used in this present invention may be surface latent image type emulsions or internal latent image type emulsions. Internal latent image type emulsions are combined with nucleating agents or light fogging and used as direct reversal emulsions. Furthermore, so-called core/shell emulsions in which the interior of the grain and the grain surface layer are comprised of different phases can also be used. The silver halide emulsion may be mono-disperse or poly-disperse, and mixtures of mono-disperse emulsions can be used. The grain size is from 0.1 to 2 μm, and most desirably from 0.2 to 1.5 μm. The crystal habit of the silver halide grains may be octahedral, tetradecahedral or tabular with a high aspect ratio or of some other form.

In practice, any of the silver halide emulsions disclosed, for example, in column 50 of U.S. Pat. No. 4,500,626, U.S. Pat. No. 4,628,021, *Research Disclosure* (referred to hereinafter as RD) 17029 (1978) and JP-A-62-253159 can be used.

The silver halide emulsions can be used as they are with no post-ripening, but they are used generally after chemical sensitization. The known methods of sulfur sensitization, reduction sensitization, precious metal sensitization and selenium sensitization, for example, can be used individually or in combination with emulsions for the normal type of photosensitive element. These methods of chemical sensitization can also be carried out in the presence of a nitrogen-containing heterocyclic compound (JP-A-62-253159).

The coated weight of photosensitive silver halide used in this present invention is within the range of from 1 mg to 10 grams, calculated as silver, per square meter.

The silver halide used in this invention may be sensitized spectrally with methine dyes or by other means. The dyes which may be used include cyanine dyes, merocyanine dyes, complex cyanine dyes, complex merocyanine dyes, holopolar cyanine dyes, hemi-cyanine dyes, styryl dyes and hemi-oxonol dyes.

Actual examples include the sensitizing dyes disclosed, for example, in U.S. Pat. No. 4,617,257, JP-A-59-180550, JP-A-60-140335 and RD 17029 (1978) pages 12–13.

These sensitizing dyes can be used individually, or in combination with a view to achieving super-sensitization.

Compounds which exhibit super-sensitization, which is to say dyes which themselves have no spectrally sensitizing action or compounds which essentially do not absorb visible light (for example, those disclosed in U.S. Pat. No. 3,615,641 and JP-A-63-23145) may be included in an emulsion along with the sensitizing dyes.

The sensitizing dyes may be added to the emulsion during, before or after chemical sensitization, and they may be added before or after nuclei formation of the silver halide grains as disclosed in U.S. Pat. Nos. 4,183,756 and 4,225,666. The amount added is generally from $10^{-8}$ to $10^{-2}$ mol per mol of silver halide.

The dye donating compounds of this present invention are compounds which generate or release diffusible dyes in accordance with the reaction or in counter-accordance with the reaction when silver ion is reduced to silver. The compounds are all referred to hereinafter as dye donating compounds for the sake of simplicity.

Examples of dye donating compounds which can be used in the present invention include first of all the compounds (couplers) which form dyes by means of an oxidative coupling reaction. The couplers may be four-equivalent couplers or two-equivalent couplers, but two-equivalent couplers which have a non-diffusible group as a leaving group and form diffusible dyes by means of an oxidative coupling reaction are preferred. The non-diffusible group may take the form of a polymer chain. Actual examples of color developing agents and couplers have been described in detail in, for example, *The Theory of the Photographic Process*, by T. H. James, fourth edition, pages 291–334 and 354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Furthermore, compounds which have the function of releasing or dispersing dispersible dyes in the form of the image are another type of dye donating compound. Compounds of this type can be represented by the general formula [LI] indicated below.

$$(Dye—Y_1)_n—Z \quad \text{(LI)}$$

Dye represents a dye group which has been temporarily shifted to the short wave length side or a dye precursor group, $Y_1$ represents a single bond or a linking group, Z represents a group which has the nature of producing a difference in the diffusibility of the compound represented by $(Dye)—Y_1)_n—Z$, or which releases Dye and produces a difference in the diffusibilities of the released Dye and $(Dye—Y_1)_n—Z$, in accordance or in counter-accordance with the photosensitive silver salt in which a latent image has been formed in the form of the image and n represents 1 or 2, and when n is 2 the two Dye-$Y_1$ moieties may be the same or different.

Actual examples of dye donating compounds which can be represented by general formula (LI) include the compounds described under the headings (1) to (5) below. Moreover, the compounds described under the headings (1) to (3) below form diffusible dye images in counter-accordance with the development of the silver halide (positive dye images) and those described under the headings (4) and (5) form diffusible dye images in accordance with the development of the silver halide (negative dye images).

(1) Dye developing agents in which a dye component is connected with a hydroquinone-based developing agent as disclosed, for example, in U.S. Pat. Nos. 3,134,764, 3,362,819, 3,597,200, 3,544,545 and 3,482,972. These dye developing agents are diffusible under alkaline conditions but are rendered fast to diffusion on reaction with silver halide.

(2) Non-diffusible compounds which release diffusible dyes under alkaline conditions but which lose this ability on reaction with silver halide as disclosed in U.S. Pat. No. 4,503,137 also can be used. Examples include the compounds which release diffusible dyes by means of an intramolecular nucleophilic substitution reaction disclosed in U.S. Pat. No. 3,980,479 and the compounds which release diffusible dyes by means of an intramolecular substitution reaction of an isooxazolone ring disclosed in U.S. Pat. No. 4,199,354.

(3) Non-diffusible compounds which react with reducing agents which remain un-oxidized by development and release diffusible dyes as disclosed, for example, in U.S. Pat. No. 4,559,290, European Patent 220,746A2, U.S. Pat. No. 4,783,396 and Kokai Giho 87-6199, also can be used.

Examples include the compounds which release diffusible dyes by means of an intramolecular nucleophilic substitution reaction after reduction disclosed, for example, in U.S. Pat. Nos. 4,139,389 and 4,139,379, JP-A-59-185333 and JP-A-57-84453, the compounds which release a diffusible dye by means of an intramolecular electron transfer reaction after reduction disclosed, for example, in U.S. Pat. No. 4,232,107, JP-A-59-101649, JP-A-61-88257 and RD 24025 (1984); the compounds which release a diffusible dye via single bond cleavage after reduction disclosed, for example, in West German Patent 3,008,588A, JP-A-56-142530 and U.S. Pat. Nos. 4,343,893 and 4,619,884, the nitro compounds which release diffusible dyes after accepting an electron disclosed, for example, in U.S. Pat. No. 4,450,223, and the compounds which release diffusible dyes after accepting an electron disclosed, for example, in U.S. Pat. No. 4,609,610.

Furthermore, the compounds which have electron withdrawing groups and N-X bonds (where X represents an oxygen, sulfur or nitrogen atom) within the molecule disclosed, for example, in European Patent 220,746A2, Kokai Giho 87-6199, U.S. Pat. No. 4,783,396, JP-A-63-201653 (U.S. Pat. No. 4,891,304) and JP-A-63-201654, the compounds which have electron withdrawing groups and $SO_2$-X bonds (where X has the same significance as described above) within the molecule disclosed in JP-A-1-26842 (U.S. Pat. No. 4,840,887) the compounds which have electron withdrawing groups and PO-X bonds (where X has the same significance as described above) within the molecule disclosed in JP-A-63-271344 and the compounds which have electron withdrawing groups and C—X' bonds (where X' is the same as X or —$SO_2$—) disclosed in JP-A-63-271341 are more desirable. Furthermore, the compounds which release diffusible dyes on cleavage of a single bond after reduction by means of a $\pi$-bond which is conjugated with an electron accepting group disclosed in JP-A-1-161237 and JP-A-1-161342 can also be used.

From among these compounds, those which have an electron withdrawing group and an N-X bond with the molecule are especially desirable. Actual examples include compounds (1)–(3), (7)–(10), (12), (13), (15), (23)–(26), (31), (32), (35), (36), (40), (41), (44), (53)–(59), (64) and (70) disclosed in U.S. Pat. No. 4,783,396 and in European Patent 220,746A2, and compounds (11)–(23) disclosed in Kokai Giho 87-1699.

These compounds produce remarkably excellent color images reversely corresponding to a development of silver halide. An amount of these compounds to be used is in 0.05 to 5 mmol/$m^2$, more preferably 0.1 to 1 mmol/$m^2$.

(4) Compounds which release diffusible dyes by means of a reaction with the oxidized form of a reducing agent, being couplers which have a diffusible dye as a leaving group (DDR couplers). Actual examples include those disclosed in British Patent 1,330,524, JP-B-48-39165 and U.S. Pat. Nos. 3,443,940, 4,474,867 and 4,483,914. (The term "JP-B" as used herein signifies an "examined Japanese patent publication".)

(5) Compounds which are reducing with respect to silver halide or organic silver salts and which release diffusible dyes on reduction (DRR compounds). Other reducing agents cannot be used with these compounds and so there are problems with image staining due to oxidative degradation of the reducing agent and this is undesirable. Actual examples have been disclosed, for example, in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Patents 3,725,062, 3,728,113 and 3,443,939, JP-A-58-116537, JP-A-57-179840 and U.S. Pat. No. 4,500,626. Actual examples of DDR compounds include the compounds disclosed in columns 22 to 44 of the aforementioned U.S. Pat. No. 4,500,626, and compounds (1)–(3), (10)–(13), (16)–(19), (28)–(30), (33)–(35), (38)–(40) and (42)–(64) disclosed in the aforementioned U.S. Pat. No. 4,500,626 are preferred. Furthermore, the compounds disclosed in columns 37–39 of U.S. Pat. No. 4,639,408 can also be used.

Furthermore, the dye-silver compounds in which a dye is bonded to an organic silver salt (*Research Disclosure*, May 1978, pages 54–58, for example), the azo dyes which are used in the heat-developable silver dye bleach method (U.S. Pat. No. 4,235,957, *Research Disclosure*, April 1976, pages 30–32, for example) and leuco dyes (U.S. Pat. Nos. 3,985,565 and 4,022,617, for example) can also be used as dye donating compounds other than the couplers and compounds of general formula [LI] described above.

Various anti-fogging agents or photographic stabilizers can be used in this present invention. For example, use can be made of the azoles and azaindenes disclosed on pages 24–35 of RD 17643 (1978), the nitrogen containing carboxylic acids and phosphoric acids disclosed in JP-A-59-168442, the mercapto compounds and their metal salts disclosed in JP-A-59-111636 and the acetylene compounds disclosed in JP-A-62-87957.

The use of hydrophilic binders for the binder in the structural layers of the photosensitive materials and dye fixing materials other than the layer which contains the aforementioned natural macromolecular polysaccharide originating from red algae (rhodophyta) is desirable. Examples include those disclosed on pages 26–28 of JP-A-62-253159. In practical terms, transparent or semi-transparent hydrophilic binders are preferred. Examples include proteins, such as gelatin and gelatin derivatives, and other natural compounds, such as cellulose derivatives, polysaccharides, such as starch, gum arabic, dextran and pluran, poly(vinyl alcohol), polyvinylpyrrolidone, acrylamide polymers and other synthetic polymeric compounds. Furthermore, the highly water absorbent polymers disclosed in JP-A-62-245260, which is to say homopolymers of vinyl monomers which have a —COOM group or an —$SO_3M$ group (where M represents a hydrogen atom or an alkali metal) or copolymers of the vinyl monomers or copolymers of the vinyl monomers with other vinyl monomers (for example, sodium methacrylate, ammonium methacrylate or Sumikagel L-5H made by the Sumitomo Chemical Co.) can also be used. Two or more of the binders also can be used in combination.

In a system in which a trace of water is supplied and thermal development is carried out, it is possible to use the polymers which have a high water uptake described above to take-up water rapidly. Furthermore, when a polymer which has a high water uptake is used in a dye fixing layer or in a dye fixing layer protective layer, it is possible to prevent the re-transfer of dye from one dye fixing material to another once transfer has been accomplished.

The coated weight of binder in the present invention is preferably not more than 20 grams per square meter, and more desirably it is not more than 10 grams per square meter, while most desirably it is not more than 7 grams per square meter.

Various polymer latexes can be included in the structural layers (including the backing layers) of a photosensitive material or dye fixing material with a view to improving film properties, for example, providing dimensional stability, preventing the occurrence of curl, preventing the occurrence of sticking, preventing the formation of cracks in the film and preventing the occurrence of pressure sensitization or desensitization. Actual examples include all of the polymer latexes disclosed, for example, in JP-A-62-245258, JP-A-62-136648 and JP-A-62-110066. In particular, it is possible to prevent the occurrence of cracking of a mordant layer if a polymer latex which has a low glass transition point (below 40° C.) is used in the mordant layer, and an excellent anti-curl effect can be realized by using a polymer latex which has a high glass transition point in a backing layer.

In cases where a photosensitive material of this present invention is processed by thermal development, organometallic salts can be used conjointly as oxidizing agents along with the photosensitive silver halide. The use of organic silver salts from among these organometallic salts is especially desirable.

The benzotriazoles, fatty acids and other compounds disclosed, for example, in columns 52–53 of U.S. Pat. No. 4,500,626 can be used as organic compounds for forming the organic silver salt oxidizing agents mentioned above. Furthermore, the silver salts of carboxylic acids which have alkynyl groups, such as the silver phenylpropiolate disclosed in JP-A-60-113235, and the silver acetylenes disclosed in JP-A-61-249044, can also be used. Two or more organic silver salts can be used conjointly.

The above mentioned organic silver salts can be used conjointly in amounts of from 0.01 to 10 mol, and preferably of from 0.01 to 1 mol, per mol of photosensitive silver halide. The total amount of photosensitive silver halide and organic silver salt coated is suitably from 50 mg to 10 grams per square meter when calculated as silver.

In this present invention, the reducing agent may be incorporated into the photosensitive material or it may be supplied to the photosensitive material (and the dye fixing material) at the time of processing as one component of a processing composition which is contained in a burstable container. The former embodiment is preferred when processing is carried out with thermal development and the latter embodiment is preferred when processing is carried out with a so-called color diffusion transfer process at near normal temperature.

Any of the reducing agents known in this field can be used. Furthermore, the dye donating compounds which have reducing properties described hereinafter can also be included (other reducing agents can also be used conjointly in this case). Furthermore, reducing agent precursors which themselves have no reducing properties but which achieve reducing properties as a result of the action of a nucleophilic reagent or heat during the development process can also be used.

Examples of reducing agents which can be used in this present invention include the reducing agents and reducing agent precursors disclosed, for example, in columns 49–50 of U.S. Pat. No. 4,500,626, columns 30–31 of U.S. Pat. No. 4,483,914, U.S. Pat. Nos. 4,330,617 and 4,590,152, pages 17–18 of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256 and pages 78 - 96 of European Patent 220,746A2.

Combinations of various reducing agents such as those disclosed in U.S. Pat. No. 3,039,869 can also be used.

In cases where a reducing agent which is fast to diffusion is used, combination with an electron transfer agent and/or an electron transfer agent precursor can be used in order to promote electron transfer between the non-diffusible reducing agent and the developable silver halide.

Electron transfer agents or precursors thereof can be selected from among the reducing agents and precursors thereof described earlier. The electron transfer agent or precursor thereof preferably has a higher degree of diffusibility than the non-diffusible reducing agent (electron donor). Especially useful electron transfer agents are 1-phenyl-3-pyrazolidones and aminophenols.

The reducing agents (electron donors) which are fast to diffusion which are used in combination with the electron transfer agents should be those from among the aforementioned reducing agents which are essentially immobile in the layers of the photosensitive material, and preferred examples include hydroquinones, sulfonamidophenols, sulfonamidonaphthols, the compounds disclosed as electron donors in JP-A-53-110827 and the dye donating compounds which have reducing properties but which are fast to diffusion as described hereinafter.

The amount of reducing agent added is from 0.001 to 20 mol, and most desirably from 0.01 to 10 mol, per mol of silver.

The hydrophobic additives such as the dye donating compounds and non-diffusible reducing agents, for example, can be introduced into the layers of a photosensitive material using known methods such as those described, for example, in U.S. Pat. No. 2,322,027. In this case, high boiling point organic solvents such as those disclosed, for example, in JP-A-59-83154, JP-A-59,178451, JP-A-59-178452, JP-A-59-178453, JP-A-59-178454, JP-A-59-178455 and JP-A-59-178457 can be used in conjunction with low boiling point organic solvents of boiling point from 50° C. to 160° C., as required. The amount of high boiling point organic solvent is not more than 10 grams, and preferably not more than 5 grams, per gram of dye donating compound used. Furthermore, they are suitably used in amounts of not more than 1 cc, preferably not more than 0.5 cc, and most desirably of not more than 0.3 cc, per gram of binder.

The methods of dispersion with polymers disclosed in JP-B-51-39853 and JP-A-51-59943 can also be used.

In the case of compounds which are essentially insoluble in water, the compounds can be included by dispersion as fine particles in the binder as well as using the method described above.

Various surfactants can be used when hydrophobic compounds are being dispersed in a hydrophilic colloid. For example, use can be made of the surfactants disclosed on pages 37–38 of JP-A-59-157636.

Compounds which activate development and at the same time stabilize the image can be used in a photosensitive material in cases where thermal development is used for processing. Actual examples of compounds of which the use is preferred have been disclosed in columns 51–52 of U.S. Pat. No. 4,500,626.

In a system of this present invention where the image is formed by dye diffusion transfer, a dye fixing material is used along with the photosensitive material. The dye fixing material may be an embodiment in which it is coated separately on a separate support from the photosensitive material or it may be an embodiment in which it is coated on the same support as the photosensitive material. The relationships disclosed in column 57 of U.S. Pat. No. 4,500,626 can also be used in respect of the relationship between the photosensitive material and the dye fixing material, the relationship with the support and the relationship with a white reflecting layer.

The dye fixing materials preferably used in this present invention have at least one layer which contains a mordant and a binder. The mordants known in the field of photography can be used for the mordant and actual examples include the mordants disclosed in columns 58–59 of U.S. Pat. No. 4,500,626 and on pages 32–41 of JP-A-61-88256, and those disclosed in JP-A-62-244043 and JP-A-62-244036. Furthermore, transition metal ions may be included for chelation by the dyes which have diffused. Other methods of fixing dyes include the use of polymeric compounds which have dye accepting properties such as those disclosed in U.S. Pat. No. 4,463,079.

Auxiliary layers, such as protective layers, peeling layers, neutralizing layers, timing layers and anti-curl layers for example, can be established, as required, in a dye fixing material. The establishment of a protective layer is especially useful.

Moreover, in cases where thermal development is used for processing there is no need for such a high pH value and so there is no need for the establishment of neutralizing layers and timing layers in the photosensitive materials or dye fixing materials.

High boiling point organic solvents can be used as plasticizers, slip agents or as agents for improving the peeling properties of a photosensitive material and a dye fixing material in the structural layers of the photosensitive and dye fixing materials. In practice, use can be made of those disclosed, for example, on page 25 of JP-A-62-253159 and in JP-A-62-245253.

Moreover, various silicone oils (all of the silicone oils ranging from dimethylsilicone oil through to the modified silicone oils in which various organic groups have been introduced into dimethylsiloxane) can be used for the above mentioned purpose. As an example, the various modified silicone oils described in data sheet P6-18B, "Modified Silicone Oils", put out by the Shin-Etsu Silicone Co., and especially the carboxy modified silicone of trade name X-22-3710, are effective.

Furthermore, the silicone oils disclosed in JP-A-62-215953 and JP-A-63-46449 are also effective.

Anti-color fading agents may be used in the photosensitive materials and dye fixing materials. Antioxidants, ultraviolet absorbers and certain types of metal complex, for example, can be used as anti-color fading agents.

Examples of antioxidants include chroman-based compounds, coumaran-based compounds, phenol-based compounds (for example, hindered phenols), hydroquinone derivatives, hindered amine derivatives and spiroindane-based compounds. Furthermore, the compounds disclosed in JP-A-61-159644 are also effective.

Benzotriazole compounds (for example, U.S. Pat. No. 3,533,794), 4-thiazolidone-based compounds (for example, U.S. Pat. No. 3,352,681, benzophenone-based compounds (for example, JP-A-46-2784) and the compounds disclosed in JP-A-54-48535, JP-A-62-136641 and JP-A-61-88256, for example, are ultraviolet absorbers. Furthermore, the ultraviolet absorbing polymers disclosed in JP-A-62-260152 are also effective.

The compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages 27–29 of JP-A-61-88256, JP-A-63-199248, JP-A-1-75568 and JP-A-1-74272 can be used as a metal complex.

Examples of useful anti-color fading agents have been disclosed on pages 125–137 of JP-A-62-215272.

Anti-color fading agents for preventing the fading of dyes which have been transferred to a dye fixing material may be included beforehand in the dye fixing material or they may be supplied to the dye fixing material from the outside, from the photosensitive material, for example.

The above mentioned antioxidants, ultraviolet absorbers and metal complexes may be used in combination.

Fluorescent whiteners may be used in the photosensitive and dye fixing materials. In particular, fluorescent whiteners are preferably incorporated into the dye fixing material or supplied to the dye fixing material from the outside, from the photosensitive material, for example. As an example, the compounds disclosed, for example, in chapter 8 of volume V of *The Chemistry of Synthetic Dyes* by K. Veenkataraman and JP-A-61-143752 can be used. In more practical terms, use can be made, for example, of stilbene-based compounds, coumarin-based compounds, biphenyl-based compounds, benzoxazole-based compounds, naphthalimide-based compounds, pyrazoline-based compounds and carbostiryl-based compounds.

Fluorescent whiteners can be used in combination with anti-color fading agents.

The film hardening agents disclosed, for example, in column 41 of U.S. Pat. No. 4,678,739, JP-A-59-116655, JP-A-62-245261 and JP-A-61-18942 can be used as film hardening agents in the structural layers of photosensitive materials and dye fixing materials. In more practical terms, use can be made of aldehyde-based film hardening agents (formaldehyde for example), aziridine-based film hardening agents, epoxy-based film hardening agents

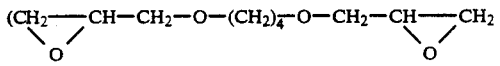

for example), vinylsulfone-based film hardening agents (N,N'-ethylene-bis(vinylsulfonylacetamido)ethane, for example), N-methylol-based film hardening agents (dimethylolurea, for example) or polymeric film hardening agents (the compounds disclosed, for example, in JP-A-62-234157).

Various surfactants can be used in the structural layers of photosensitive materials and dye fixing materials as coating promotors, for improving peelability, for improving slip properties, for antistatic purposes or for accelerating development, for example. Actual examples of surfactants have been disclosed, for example, in JP-A-62-173463 and JP-A-62-183457.

Organic fluorine compounds may be included in the structural layers of a photosensitive material or dye fixing material with a view to improving slip properties, for anti-static purposes or for improving peeling properties, for example. Typical examples of organic fluorine compounds include the fluorine-based surfactants disclosed, for example, in columns 8–17 of JP-B-57-9053, JP-A-61-20944 and JP-A-62-135826, and the oil-like fluorine-based compounds such as fluorine oil and hydrophobic fluorine compounds including solid fluorine compound resins such as the tetrafluoroethylene resins.

Matting agents can be used in the photosensitive materials and dye fixing materials. As well as the compounds such as silicon dioxide and the polyolefins or polymethacrylates disclosed on page 29 of JP-A-61-88256, the compounds disclosed in JP-A-63-274944, and JP-A-63-274952, such as benzoguanamine resin beads, polycarbonate resin beads and AS resin beads, for example, can be used as matting agents.

Furthermore, thermal solvents, anti-foaming agents, biocides, fungicides and colloidal silica, for example, may be included in the photosensitive materials and dye fixing materials. Actual examples of these additives have been disclosed on pages 26–32 of JP-A-61-88256.

Image forming accelerators can be used in a photosensitive material and/or dye fixing material. The use of image forming accelerators is especially desirable in cases where processing is carried out using thermal development. Image forming accelerators are compounds which function in such a way as to accelerate the redox reaction of a silver salt oxidizing agent and a reducing agent, to accelerate the reaction which produces a dye from the dye donating substance, which breaks down a dye or which releases a diffusible dye, for example, and to accelerate the migration of a dye from a photosensitive layer to a dye fixing layer. On the basis of physico-chemical function, the compounds can be divided into bases or base precursors, nucleophilic compounds, high boiling point organic solvents (oils), thermal solvents, surfactants, and compounds which interact with silver or silver ion, for example. However, these groups of substances generally have a complex function and normally combine some of the above mentioned accelerating effects. Details have been disclosed in columns 38–40 of U.S. Pat. No. 4,678,739.

Base precursors are, for example, salts of a base and an organic acid which is decarboxylated by heating or compounds which release amines by an intramolecular nucleophilic substitution reaction, a Lossen rearrangement or a Beckmann rearrangement. Actual examples have been disclosed, for example, in U.S. Pat. No. 4,511,493 and JP-A-62-65038.

In the systems in which thermal development and dye transfer are carried out simultaneously in the presence of a small amount of water, the base or base precursor preferably is included in the dye fixing material in order to ensure good storage properties for the photosensitive material.

Apart from the above, the combinations of sparingly soluble metal compounds and compounds which can take part in a complex forming reaction (known as complex forming compounds) with the metal ions from which these sparingly soluble metal compounds are formed disclosed in European Patent Laid Open 210,660 and U.S. Pat. No. 4,740,445, and the compounds which produce bases by electrolysis disclosed in JP-A-61-232451, for example, can also be used as base precursors. The former method is particularly effective. Sparingly soluble metal compounds and complex forming compounds are usefully added separately to a photosensitive material and a dye fixing material.

Various development terminating agents can be used in the photosensitive materials and/or dye fixing materials of the present invention with a view to obtaining a constant image irrespective of fluctuations in the processing temperature and the processing time during development.

Here, the term "development terminator" signifies a compound which, after proper development, neutralizes the base or reacts with the base, reduces the base concentration in the film and terminates development, or a compound which interacts with silver and silver salts and inhibits development. In practice, these compounds include acid precursors which release an acid on heating, electrophilic compounds which undergo substitution reactions with a base on heating and nitrogen containing heterocyclic compounds, mercapto compounds and precursors of these compounds. Further details have been disclosed on pages 31–32 of JP-A-62-253159.

Paper and synthetic polymers (films) generally are used for the support of the photosensitive materials and dye fixing materials of this present invention. In practice, use can be made of supports comprised of poly(ethylene terephthalate), polycarbonate, poly(vinyl chloride), polystyrene, polypropylene, polyimide, cellulose derivatives (for example, triacetylcellulose) or supports wherein a pigment such as titanium oxide is included within the films, film-type synthetic papers made from polypropylene, papers made from a synthetic resin, such as polyethylene, pulp and natural pulp, Yankee paper, baryta paper, coated papers (especially cast coated papers), metals, cloths and glasses, for example.

The supports can be used individually, or supports which have been laminated on one side or on both sides with a synthetic polymer, such as polyethylene, for example, can also be used.

The supports disclosed on pages 29–31 of JP-A-62-253159 can also be used.

Hydrophilic binder and a semiconductive metal oxide such as tin oxide or alumina sol, carbon black or other anti-static agents, may be coated on the surface of the support.

The methods which can be used for exposing and recording an image on a photosensitive material include those in which the picture of a view or a person is taken directly using a camera, for example, methods in which an exposure is made though a reversal film or a negative film using a printer or an enlarger, methods in which a scanning exposure of an original is made through a slit using the exposing device of a copying machine, for example, methods in which the exposure is made with light emitted from light emitting diodes or various types of lasers, being controlled by electrical signals in accordance with picture information, and methods in which exposures are made directly or via an optical system using the output of image information on an image display device such as a CRT, a liquid crystal display, an electro-luminescent display or a plasma display, for example.

As indicated above, natural light, tungsten lamps, light emitting diodes, laser light sources and CRT light sources, for example, the light sources disclosed in column 56 of U.S. Pat. No. 4,500,626, can be used as light sources for recording images on a photosensitive material.

Furthermore, image exposures can also be made using wavelength conversion elements in which a non-linear optical material is combined with a coherent light source such as laser light for example. Here, a non-linear optical material is a material which is such that when irradiated with a strong photoelectric field such as laser light, it exhibits a non-linearity between the apparent polarization and the electric field, and inorganic compounds as typified by lithium niobate, potassium dihydrogen phosphate (KDP), lithium iodate and $BaB_2O_4$, urea derivatives, nitroaniline derivatives, nitropyridine-N-oxide derivatives such as 3-methyl-4-nitropyridine-N-oxide (POM), for example, and the compounds disclosed in JP-A-61-53462 and JP-A-62-210432 are preferably used for this purpose. Any of the known embodiments of wavelength converting elements such as the single crystal optical wave guide type and the fibre type can be used.

Furthermore, the aforementioned image information may be an image signal which has been obtained using a video camera or an electronic still camera, for example, a television signal as typified by the Japanese television signal specification (NTSC), an image signal obtained by dividing an original into a plurality of picture elements using a scanner, for example, or an image signal which has been generated using a computer as typified by CG and CAD, for example.

The photosensitive material and/or dye fixing material may be such that they have an electrically conductive heat generating layer as a means of heating for thermal development purposes or for the diffusion transfer of dyes by heating. In such a case a transparent or opaque heat generating element as disclosed, for example, in JP-A-61-145544 can be used. Moreover, such an electrically conductive layer also functions as an anti-static layer.

Diffusion transfer photographic materials of the present invention may be processed using the so-called color diffusion transfer method in which image formation is achieved using an alkali processing composition at close to normal temperature, or they may be processed by thermal development. The various known systems can be adopted for the color diffusion transfer method.

Processing by thermal development is described in more detail below.

Thermal development is possible at temperatures of from about 50° C. to about 250° C., but heating temperatures of from about 80° C. to about 180° C. are especially useful in the thermal development process. A dye diffusion transfer process may be carried out at the same time as thermal development, or it may be carried out after completion of the thermal development process. In the latter case, transfer is possible with heating temperatures for the transfer process within the range from the temperature in the thermal development process to room temperature, but temperatures of at least 50° C. and up to about 10° C. lower than the temperature during the thermal development process are preferred.

Dye transfer can be achieved by heat alone, but solvents may be used to promote dye transfer.

Furthermore, the methods in which development and transfer are carried out simultaneously or successively by heating in the presence of a small amount of solvent (especially water) as described in detail, for example, in JP-A-59-218443 and JP-A-61-238056 are also useful. In these methods the heating temperature is preferably at least 50° C. but below the boiling point of the solvent and, for example, when water is used for the solvent a temperature of at least 50° C. but less than 100° C. is desirable.

Water or a basic aqueous solution which contains an inorganic alkali metal salt or an organic base (the bases disclosed in the section on image forming accelerators can be used for the base) can be cited as examples of solvents which can be used to accelerate development and/or transfer a diffusible dye into a dye fixing layer. Furthermore, low boiling point solvents or mixtures of low boiling point solvents and water or basic aqueous solutions, for example, can also be used. Furthermore, surfactants, anti-fogging agents, and sparingly soluble metal salts and complex forming compounds, for example, may be included in the solvent.

The solvents may be applied to the dye fixing material, to the photosensitive material or to both materials. The amount used should be small, being less than the amount of solvent corresponding to the maximum swelled volume of the whole coated film (in particular, less than the amount obtained on subtracting the weight of the whole coated film from the weight of solvent corresponding to the maximum swelled volume of the whole coated film).

The method described on page 26 of JP-A-61-147244 can be used, for example, for applying the solvent to the photosensitive layer or dye fixing layer. Furthermore, the solvent can also be incorporated into the photosensitive material, the dye fixing material or both of these materials beforehand in a form in which it has been enclosed by micro-encapsulation.

Furthermore, methods in which a hydrophilic thermal solvent, which is a solid at normal temperature but melts at elevated temperatures, is incorporated in the photosensitive material or dye fixing material can also be used for accelerating dye transfer. The hydrophilic thermal solvent may be incorporated into the photosensitive material or the dye fixing material, or it may be incorporated into both materials. The layer into which it is incorporated may be an emulsion layer, an intermediate layer, a protective layer or a dye fixing layer, but it is preferably incorporated into a dye fixing layer and/or a layer adjacent thereto.

Examples of hydrophilic thermal solvents include ureas, pyridines, amides, sulfonamides, imides, alcohols, oximes and other heterocyclic compounds.

Furthermore, high boiling point organic solvents may be included in the photosensitive material and/or dye fixing material in order to accelerate dye transfer.

Sometimes the material is brought into contact with a heated block or plate, sometimes the material is brought into contact with a hot plate, a hot presser, a heated roller, a halogen lamp heater or an infrared or far-infrared lamp heater for example, and sometimes the material is passed through a high temperature atmosphere as a means of heating in the development and/or transfer process.

The method by which the photosensitive material and the dye fixing material are brought together under pressing conditions during contact and with pressure applied as disclosed on page 27 of JP-A-61-147244 can be used.

Any of the various development devices can be used for processing photographic materials of this present invention. For example, use of the devices disclosed, for example, in JP-A-59-75247, JP-A-59-177547, JP-A-59-181353, JP-A-60-18951 and JP-A-U-62-25944 is desirable. (The term "JP-A-U" as used herein signifies an "unexamined published Japanese utility model application").

The invention will be described further in the following non-limiting examples. Unless otherwise indicated, all parts, percent and ratio are by weight.

EXAMPLE 1

The method of preparing emulsion (I) for use in the first layer is described below.

Solutions (I) and (II) indicated below were added simultaneously at an even flow rate over a period of 30 minutes to a thoroughly agitated aqueous gelatin solution (a solution obtained by adding 20 grams of gelatin, 0.3 gram of potassium bromide, 6 grams of sodium chloride and 30 mg of reagent A indicated below to 800 ml of water and maintaining at a temperature of 50° C.). Subsequently, solutions (III) and (IV) indicated below were added simultaneously over a period of 30 minutes. Furthermore, the dye solution indicated below was added over a period of 20 minutes, starting 3 minutes after the commencement of the addition of solutions (III) and (IV).

After washing with water and de-salting, 22 grams of lime-treated ossein gelatin was added and, after adjustment to pH 6.2 and pAg 7.7, sodium thiosulfate, 4-hydroxy-6-methyl-1,3,3a,7-tetra-azaindene and chloroauric acid, were added and the mixture was sensitized, chemically optimally at 60° C. A monodisperse cubic silver chlorobromide emulsion of average grain size of 0.38 μm was obtained in this way. The recovery was 635 grams.

| | Solution (I) Water Added 200 ml | Solution (II) Water Added 200 ml | Solution (III) Water Added 200 ml | Solution (III) Water Added 200 ml |
|---|---|---|---|---|
| $AgNO_3$ (grams) | 50.0 g | — | 50.0 g | — |
| KBr | — | 28.0 g | — | 35.0 g |
| NaCl | — | 3.4 g | | |

Reagent A

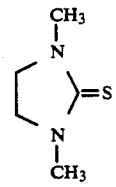

Dye Solution

The dye (a) indicated below (67mg) and 133 mg of the dye (b) indicated below were dissolved in 100 ml of methanol.

Dye (a)

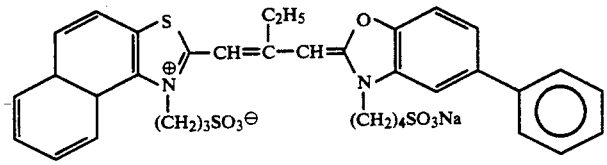

-continued

Dye (b)

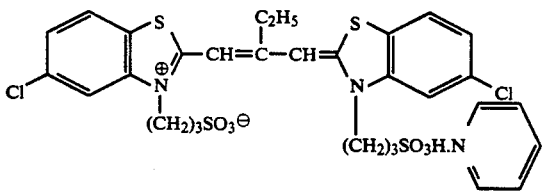

Emulsion (II) for the third layer is described below.

Solution (I) and solution (II) shown in Table B were added over a period of 30 minutes to a thoroughly agitated aqueous gelatin solution (Table A) which was being maintained at 50° C. Next, solution (III) and solution (IV) shown in table B were added over a period of 30 minutes and the dye solution shown in Table C was added 1 minute after completion of this addition.

TABLE A

| | |
|---|---|
| Gelatin | 20 grams |
| NaCl | 6 grams |
| KBr | 0.3 gram |
| 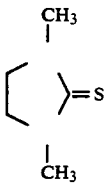 | 0.015 gram |
| $H_2O$ | 730 ml |

TABLE B

| | I | II | III | IV |
|---|---|---|---|---|
| $AgNO_3$ | 50 grams | — | 50 grams | — |
| KBr | — | 21 grams | — | 28 grams |
| NaCl | — | 6.9 grams | — | 3.5 grams |
| $H_2O$ Added to total | 200 cc | 200 cc | 200 cc | 200 cc |

TABLE C

Composition of Dye Solution

| | |
|---|---|
| 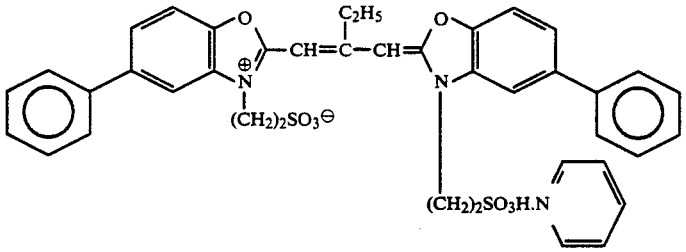 | 0.23 g |
| Methanol | 154 cc |

After washing with water and desalting, 20 grams of gelatin was added, the pH and pAg values were adjusted and chemical sensitization was carried out optimally using triethylthiourea, chloroauric acid and 4-hydroxy-6-methyl-1,3,3a,7-tetra-azaindene.

The emulsion obtained was a 0.40 μmonodisperse cubic emulsion and the recovery was 630 grams.

The preparation of emulsion (III) for the fifth layer is described below.

Solution (1) and solution (2) indicated below (Table 6-1) were added simultaneously over a period of 30 minutes to a thoroughly agitated aqueous gelatin solution (obtained by adding 20 grams of gelatin, 3 grams of potassium bromide, 0.03 gram of the compound (1) indicated below and 0.25 gram of $HO(CH_2)_2S(CH_2)_2S(CH_2)_2OH$ to 800 cc of water and maintained at 50° C.). Subsequently, solution (3) and solution (4) indicated below were added simultaneously over a period of 20 minutes. Furthermore, the dye solution indicated below was added over a period of 18 minutes starting 5 minutes after the commencement of the addition of solution (3).

After washing with water and desalting, 20 grams of lime-treated ossein gelatin was added and, after adjusting to pH 6.2 and pAg 8.5, sodium thiosulfate 4-hydroxy-6-methyl-1,3,3a,7-tetra-azaindene and chloroauric acid, were added and the mixture was sensitized, chemically. Six hundred grams of a mono-disperse cubic silver chlorobromide emulsion of average grain size 0.40 μm was obtained in this way.

TABLE 6-1

| | Solution (1) in Water 180 ml | Solution (2) in Water 180 ml | Solution (3) in Water 350 ml | Solution (4) in Water 350 ml |
|---|---|---|---|---|
| $AgNO_3$ | 30 grams | — | 70 grams | — |
| KBr | — | 17.8 grams | — | 49 grams |
| NaCl | — | 1.6 grams | — | — |

Dye Solution

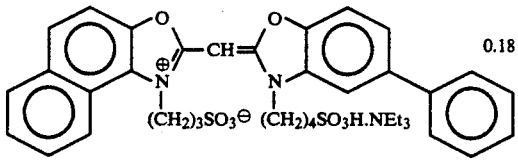

0.18 gram

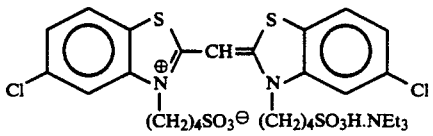

0.06 gram

The dyes indicated above were dissolved in 160 cc of methanol.

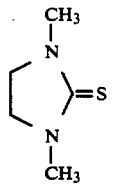

Compound (1)

The preparation of gelatin dispersions of dye donating substances is described below.

The yellow dye donating compound (1)* (18 grams), 14 grams of the electron donor (1)*, 0.62 gram of the electron transfer agent precursor (1)* and 9 grams of the high boiling point organic solvent (1)* were weighed out, 51 ml of ethyl acetate was added and a uniform solution was formed by heating to about 60° C. The solution was mixed, with stirring, with 100 grams of a 10% solution of lime-treated gelatin, 60 cc of water and 1.5 grams of sodium dodecylbenzenesulfonate and then dispersed in a homogenizer for 10 minutes at 10,000 rpm. The dispersion is referred to as the yellow dye donating substance dispersion.

Dispersions of magenta and cyan dye donating substances were prepared in the same way as the yellow dye donating substance dispersion by using the magenta dye donating compound (2)* or the cyan dye donating compound (3)*.

Photosensitive material 101 which had the structural layers indicated in Table 1 below was prepared using the materials listed therein.

TABLE 1

| Layer Number | Layer Name | Additive | | Coated Weight (g/m$^2$) |
|---|---|---|---|---|
| Sixth Layer | Protective layer | Gelatin | | 0.90 |
| | | Matting agent (silica) | | 0.03 |
| | | Water soluble polymer (1)* | | 0.02 |
| | | Surfactant (1)* | | 0.06 |
| | | Surfactant (2)* | | 0.13 |
| | | Film hardening agent (1)* | | $6 \times 10^{-3}$ |
| | | $Zn(OH)_2$ | | 0.80 |
| Fifth Layer | Blue Sensitive Emulsion Layer | Emulsion (III) | as silver | 0.38 |
| | | Gelatin | | 0.56 |
| | | Anti-foggant (1)* | | $3.0 \times 10^{-4}$ |
| | | Yellow dye donating compound (1)* | | 0.40 |
| | | High boiling point organic solvent (1)* | | 0.20 |
| | | Electron donor (1)* | | 0.31 |
| | | Electron transfer agent precursor (1)* | | 0.02 |
| | | Surfactant (3)* | | 0.05 |
| | | Film hardening agent (1)* | | $6 \times 10^{-3}$ |
| | | Water soluble polymer (1)* | | 0.02 |
| Fourth Layer | Intermediate Layer | Gelatin | | 0.70 |
| | | Reducing agent (1)* | | 0.18 |
| | | Development inhibitor releasing compound (II-12) | | 0.05 |
| | | High boiling point solvent (1)* | | 0.06 |
| | | Surfactant (3)* | | $8.2 \times 10^{-3}$ |
| | | Surfactant (1)* | | 0.02 |
| | | Surfactant (4)* | | 0.07 |
| | | Electron transfer agent (1)* | | 0.09 |
| | | Water soluble polymer (1)* | | 0.02 |
| | | Film hardening agent (1)* | | $6 \times 10^{-3}$ |
| Third Layer | Green Sensitive Emulsion Layer | Emulsion (II) | as silver | 0.21 |
| | | Gelatin | | 0.29 |
| | | Anti-foggant (1)* | | $2.0 \times 10^{-4}$ |
| | | Magenta dye donating compound (2)* | | 0.31 |
| | | High boiling point organic solvent (1)* | | 0.16 |
| | | Electron donor (1)* | | 0.17 |
| | | Electron transfer agent precursor (1)* | | 0.02 |
| | | Surfactant (3)* | | 0.04 |
| | | Film hardening agent (1)* | | $6 \times 10^{-3}$ |
| | | Water soluble polymer (1)* | | 0.02 |
| Second Layer | Intermediate Layer | Gelatin | | 0.80 |
| | | $Zn(OH)_2$ | | 0.45 |
| | | Reducing agent (1)* | | 0.18 |
| | | Development inhibitor releasing compound (II-12) | | 0.05 |
| | | High boiling point organic solvent (1)* | | 0.06 |
| | | Surfactant (3)* | | $8.2 \times 10^{-3}$ |
| | | Surfactant (1)* | | 0.06 |
| | | Surfactant (4)* | | 0.10 |
| | | Active carbon | | 0.03 |
| | | Water soluble polymer (1)* | | 0.03 |
| | | Film hardening agent (1)* | | $6 \times 10^{-3}$ |
| First Layer | Red Sensitive Emulsion Layer | Emulsion (I) | as silver | 0.22 |
| | | Gelatin | | 0.30 |
| | | Anti-foggant (1)* | | $2.0 \times 10^{-4}$ |
| | | Cyan dye donating compound (3)* | | 0.39 |
| | | High boiling point organic solvent (1)* | | 0.19 |
| | | Electron donor (1)* | | 0.19 |
| | | Electron transfer agent precorsor (1)* | | 0.02 |
| | | Surfactant (3)* | | 0.04 |
| | | Film hardening agent (1)* | | $6 \times 10^{-3}$ |
| | | Water soluble polymer (1)* | | 0.02 |
| | | Support (Poly(ethylene terephthalate), Thickness 100 μm) | | |
| Backing Layer | | Carbon black | | 0.44 |

TABLE 1-continued
| | |
|---|---|
| Polyester | 0.30 |
| Poly(vinyl chloride) | 0.30 |
Water Soluble Polymer (1)*
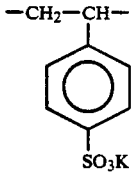
Surfactant (1)*
Aerosol OT
Surfactant (2)*
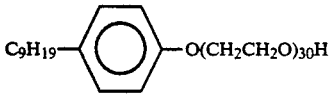
Surfactant (3)*
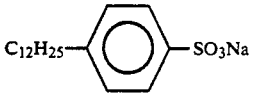
Surfactant (4)*
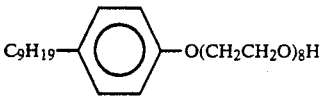
High Boiling Point Organic Solvent (1)*
Tricyclohexyl phosphate
Film Hardening Agent (1)*
1,2-Bis(vinylsulfonylacetamido)ethane
Anti-foggant (1)*
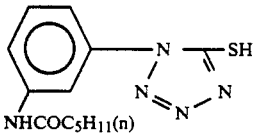
Reducing Agent (1)*
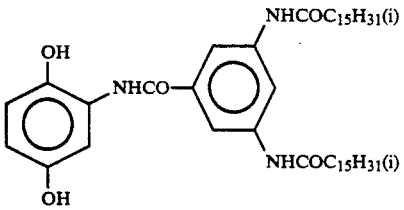
Electron Donor (1)*
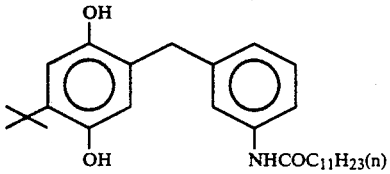
Electron Transfer Agent Precursor (1)*

TABLE 1-continued
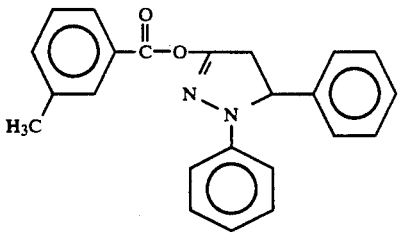
Electron Transfer Agent (1)*
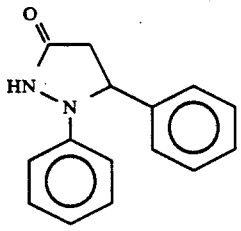
Yellow Dye Donating Compound (1)*
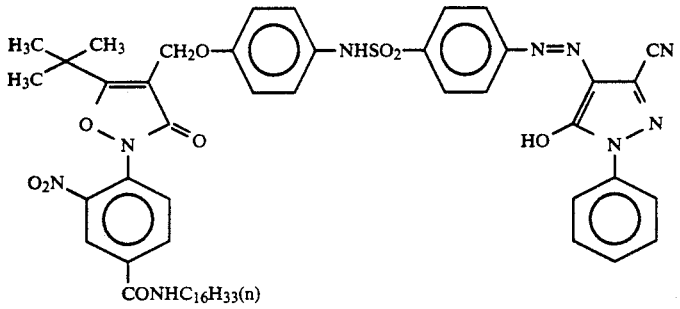
Magenta Dye Donating Compound (2)*
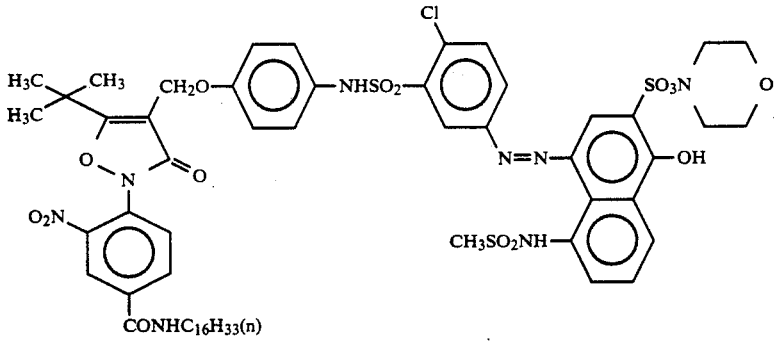
Cyan Dye Donating Compound (3)*
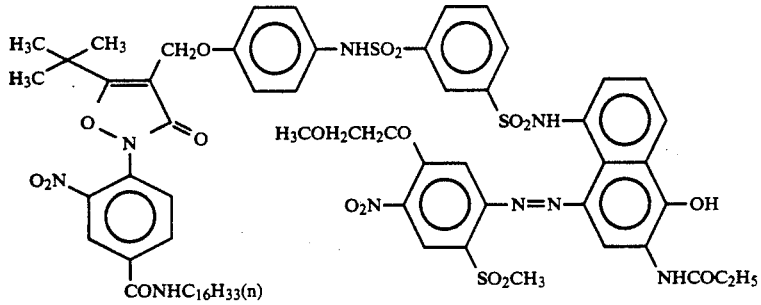
Moreover, the reducing agent (1)* was dispersed and added using the method described below.
The reducing agent (1)* (18 grams), 5 grams of the development inhibitor releasing compound (II-12) and 6 grams of the high boiling point organic solvent (1)* were formed into a uniform solution by dissolution in 20 ml of ethyl acetate and 10 ml of cyclohexanone at about 60° C. This solution was mixed, with stirring, with 100 grams of 10% aqueous lime-treated gelatin solution, 15 ml of a 5% aqueous solution of the surfactant (3)* and 0.2 gram of dodecylbenzenesulfonic acid and then the mixture was dispersed in a homogenizer for 10 minutes at 10,000 rpm. Dispersions were prepared by adding 1.5 grams of each of the compounds of this present invention (I-1), (I-5), (I-16) and (I-32) to the above-mentioned gelatin dispersion of the reducing agent (1)* and photosensitive materials 102–105 were prepared by adding these dispersions to the second and fourth layers of photosensitive materials analogous to photosensitive material 101 in such a way that the amount of reducing agent (1)* added was the same as in photosensitive material 101.

Furthermore, for comparison, the dye inhibitor releasing compound (II-12) was omitted from the above mentioned gelatin dispersion of the reducing agent (1)*, an amount of the reducing agent (1)* equimolar with the amount of development inhibitor releasing compound (II-12) was added instead and a dispersion was obtained, and photosensitive material 106 was prepared by adding this dispersion to the second and fourth layers. Moreover, photosensitive material 107 was prepared by adding compound (I-1) of this present invention to the second and fourth layers of photosensitive materials 106 in the same way as in the case of photosensitive materials 102.

The preparation of a dye fixing material is described below.

The dye fixing material R-1 was obtained by coating the structure indicated in the table below onto a paper support which had been laminated with polyethylene.

Structure of Dye Fixing Material R-1

| Number | Additive | Amount Added ($g/m^2$) |
|---|---|---|
| Third Layer | Gelatin | 0.05 |
| | Silicone oil (1) | 0.04 |
| | Surfactant (1) | 0.001 |
| | Surfactant (2) | 0.02 |
| | Surfactant (3) | 0.10 |
| | Matting agent (1) | 0.02 |
| | Guanidine picolinate | 0.45 |
| | Water soluble polymer (1) | 0.24 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (5) | 0.15 |
| First Layer | Gelatin | 0.45 |
| | Surfactant (3) | 0.01 |
| | Water soluble polymer (1) | 0.04 |
| | Film hardening agent (1) | 0.30 |
| | Support (1) | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5) | 0.01 |
| | Matting agent (2) | 0.03 |

Structure of the Support (1)

| Layer Name | Composition | | Film Thickness (μm) |
|---|---|---|---|
| Surface Under-layer | Gelatin | | 0.1 |
| Surface PE Layer (Glossy) | Low density polyethylene (density 0.923) | 89.2 parts | |
| | Surface-treated titanium oxide | 10.0 parts | 45.0 |
| | Ultramarine | 0.8 parts | |
| Pulp Layer | Top quality paper (LBKP/NBKP = 1:1) density 1.080 | | 92.6 |
| Reverse PE Layer (Matt) | High density polyethylene (density 0.960) | | 36.0 |
| Reverse Side | Gelatin | | 0.05 |
| Under-layer | Colloidal silica | | 0.05 |
| | | TOTAL | 173.8 |

Silicone Oil (1)

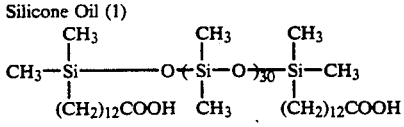

Surfactant (1)

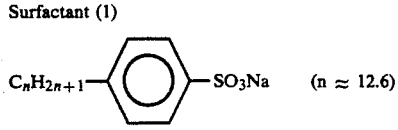

Surfactant (2)

Surfactant (3)

-continued $C_8F_{17}SO_2N(C_3H_7)CH_2COOK$ $C_{11}H_{23}CONHCH_2CH_2CH_2N^{\oplus}(CH_3)_2CH_2COO^{\ominus}$ Surfactant (4)

$NaO_3S-CH(CH_2COOCH_2CH(C_2H_5)C_4H_9)COOCH_2CH(C_2H_5)C_4H_9$

Surfactant (5)

$C_8F_{17}SO_2N(C_3H_7)(CH_2CH_2O)_4(CH_2)_4SO_4Na$

Fluorescent Whitener (1)
2,5-Bis(5-tert-butylbenzoxazole(2)thiophene

Water Soluble Polymer (1)
Sumikagel L5-H (made by Sumitomo Chemical Co.)

Water Soluble Polymer (2)
Dextran (molecular weight 70,000)

Mordant (1)

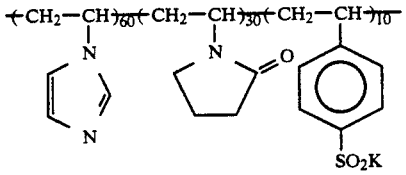

High Boiling Point Solvent (1)

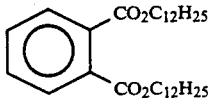

Film Hardening Agent (1)

$(CH_2)_4(O-CH_2-CH(O)-CH_2)_2$

Matting Agent (1)*
Silica

Matting Agent (2)*
Benzoguanamine resin (average particle size 15 μm)

The above mentioned multi-layer color photo-sensitive materials 101–107 were exposed through Y, M, C and gray color separation filters using a tungsten lamp.

The exposed photosensitive materials were immersed in water for 3 seconds and then passed between a pair of rubber rollers and after removal of the excess water they were laminated with the dye fixing material R-1 in such a way that the film surfaces were in contact.

The laminates were heated for 15 seconds using heated rollers of which the temperature was controlled in such a way that the temperature of the water moistened film was 80° C. On peeling away the dye fixing material subsequently clear yellow, magenta, cyan and gray images corresponding to the Y, M, C and gray color separation filters were obtained on the fixing material.

Next, (a) the magenta density when given a yellow density of 1.0, the cyan density when given a magenta density of 1.0, and the magenta density when given cyan density of 1.0 were measured and the degree of color turbidity was determined. Furthermore, the contrast (gamma value) was measured for each of the B, G and R layers in the gray part. The results obtained are shown in Table 2.

TABLE 2

| Photosensitive Material No. | Degree of Color Turbidity (a) | (b) | (c) | Gamma Value (B) | (G) | (R) |
|---|---|---|---|---|---|---|
| 101 (Comparative Example) | 0.37 | 0.31 | 0.44 | 1.9 | 1.9 | 2.0 |
| 102 (This Invention) | 0.22 | 0.20 | 0.28 | 1.8 | 1.7 | 1.9 |
| 103 (This Invention) | 0.25 | 0.21 | 0.28 | 1.7 | 1.8 | 1.8 |
| 104 (This Invention) | 0.29 | 0.28 | 0.31 | 1.8 | 1.8 | 1.9 |
| 105 (This Invention) | 0.24 | 0.21 | 0.29 | 1.7 | 1.7 | 1.8 |
| 106 (Comparative Example) | 0.52 | 0.42 | 0.51 | 2.0 | 2.0 | 2.1 |
| 107 (Comparative Example) | 0.51 | 0.40 | 0.50 | 2.0 | 2.0 | 2.1 |

It is clear from table 2 that color turbidity is suppressed by the conjoint use of a compound of the present invention with a development inhibitor releasing compound and that contrast control is possible in this way. Moreover, the minimum density ($D_{min}$) and the maximum density ($D_{max}$) of the gray part have more or less the same value for photographic materials 101–107.

EXAMPLE 2

Color photosensitive materials which had the same structure except for the fact that the development inhibitor releasing compound (II-12) in the color photosensitive materials 101–105 in Example 1 was replaced by an equimolar amount of (II-13) or (II-20) were prepared. These were processed in the same way as described in Example 1 and, on comparing photographic performance, all of the photosensitive materials to which a compound of the preset invention had been added were improved in respect of color turbidity with no reduction of the gamma value when compared to the photosensitive materials to which none had been added.

EXAMPLE 3

Multi-layer color photosensitive material 201 of which the structure is shown in Table 3 was prepared using the same emulsions as for color photosensitive material 101 described in Example 1.

Moreover, unless indicated otherwise, the additives used were the same as those in photosensitive material 101.

Moreover, the organic silver salt emulsion was prepared in the way described below.

Gelatin (28 grams) and 13.2 grams of benzotriazole were dissolved in 300 ml of water. The solution was agitated while being maintained at 40° C. A solution obtained by dissolving 17 grams of silver nitrate in 100 ml of water was added to this solution over a period of 2 minutes. Next, the excess salt was removed using a sedimentation method. Subsequently, the pH was adjusted to 6.3 and 400 grams of an organic silver salt dispersion was obtained.

TABLE 3

| Layer Number | Layer Name | Additive | | Coated Weight (g/m$^2$) |
|---|---|---|---|---|
| Sixth Layer | Protective layer | Gelatin | | 0.91 |
| | | Matting agent (silica) | | 0.03 |
| | | Surfactant (1)* | | 0.06 |
| | | Surfactant (2)* | | 0.13 |
| | | Film hardening agent (1)* | | 0.01 |
| | | Base precursor (1)* | | 0.30 |
| | | Water soluble polymer (1)* | | 0.03 |
| Fifth Layer | Blue Sensitive Emulsion Layer | Emulsion (III) | as silver | 0.30 |
| | | Organic silver salt emulsion | as silver | 0.25 |
| | | Gelatin | | 1.00 |
| | | Anti-foggant (3)* | | $1.6 \times 10^{-2}$ |
| | | Yellow dye donating compound (4)* | | 0.50 |
| | | High boiling point organic solvent (1)* | | 0.75 |
| | | Surfactant (3)* | | 0.05 |
| | | Developing agent precursor (1)* | | 0.10 |
| | | Thermal solvent (1)* | | 0.20 |
| | | Film hardening agent (1)* | | 0.01 |
| | | Base precursor (1)* | | 0.27 |
| | | Water soluble polymer (1)* | | 0.03 |
| Fourth Layer | Intermediate Layer | Gelatin | | 0.75 |
| | | Reducing agent (2)* | | 0.12 |
| | | Development inhibitor releasing compound (II-1) | | 0.04 |
| | | High boiling point solvent (1)* | | 0.06 |
| | | Surfactant (1)* | | 0.02 |
| | | Surfactant (4)* | | 0.07 |
| | | Water soluble polymer (1)* | | 0.03 |
| | | Film hardening agent (1)* | | 0.01 |
| | | Base precursor (1)* | | 0.25 |
| Third Layer | Green Sensitive Emulsion Layer | Emulsion (II) | as silver | 0.20 |
| | | Organic silver salt emulsion | as silver | 0.20 |
| | | Gelatin | | 0.85 |
| | | Anti-foggant (3)* | | $1.2 \times 10^{-2}$ |
| | | Magenta dye donating compound (5)* | | 0.37 |
| | | High boiling point organic solvent (1)* | | 0.55 |
| | | Surfactant (3)* | | 0.04 |
| | | Developing agent precursor (1)* | | 0.08 |
| | | Thermal solvent (1)* | | 0.16 |
| | | Film hardening agent (1)* | | 0.01 |
| | | Base precursor (1)* | | 0.25 |
| | | Water soluble polymer (1)* | | 0.03 |
| Second Layer | Intermediate Layer | Gelatin | | 0.80 |
| | | Reducing agent (2)* | | 0.12 |
| | | Development inhibitor releasing compound (II-1) | | 0.04 |
| | | High boiling point solvent (1)* | | 0.06 |
| | | Surfactant (1)* | | 0.06 |
| | | Surfactant (4)* | | 0.10 |
| | | Water soluble polymer (1)* | | 0.03 |
| | | Base precursor (1)* | | 0.25 |
| | | Film hardening agent (1)* | | 0.01 |
| First Layer | Red Sensitive Emulsion Layer | Emulsion (I) | as silver | 0.20 |
| | | Organic silver salt emulsion | as silver | 0.20 |
| | | Gelatin | | 0.85 |
| | | Anti-foggant (3)* | | $1.2 \times 10^{-2}$ |
| | | Thermal solvent (1)* | | 0.16 |
| | | Base precursor (1)* | | 0.25 |
| | | Cyan dye donating compound (6)* | | 0.40 |
| | | High boiling point organic solvent (1)* | | 0.60 |
| | | Surfactant (3)* | | 0.04 |
| | | Developing agent precursor (1)* | | 0.07 |
| | | Film hardening agent (1)* | | 0.01 |
| | | Water soluble polymer (1)* | | 0.03 |
| | | Support (Poly(ethylene terephthalate), Thickness 100 μm) | | |
| Backing Layer | | Carbon black | | 0.44 |

TABLE 3-continued
| | |
|---|---|
| Polyester | 0.30 |
| Poly(vinyl chloride) | 0.30 |
Anti-foggant (3)*
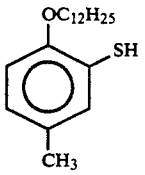
Reducing Agent (2)*
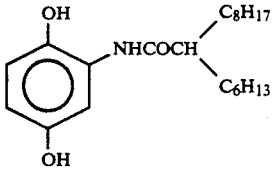
Thermal Solvent (1)*
Benzenesulfonamide
Base Precursor (1)*
Guanidine 4-chlorophenylsulfonylacetate
Developing Agent Precursor (1)*
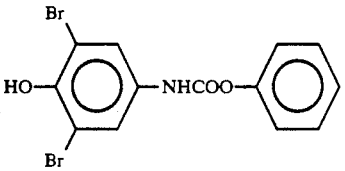
Yellow Dye Donating Compound (4)*
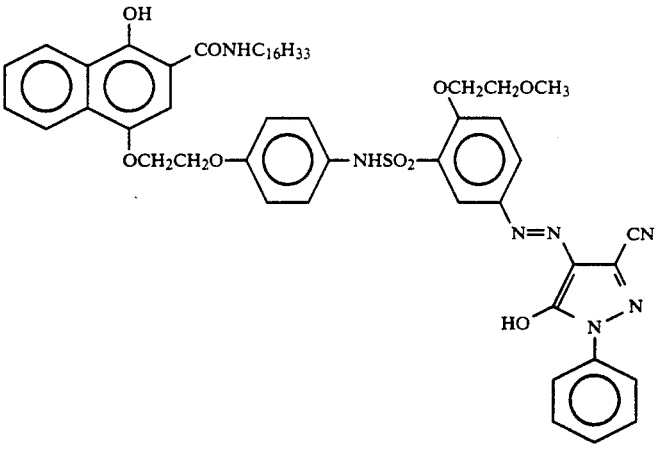
Magenta Dye Donating Compound (5)*
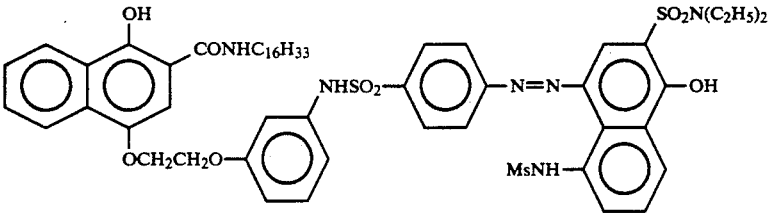
Cyan Dye Donating Compound (6)*

TABLE 3-continued

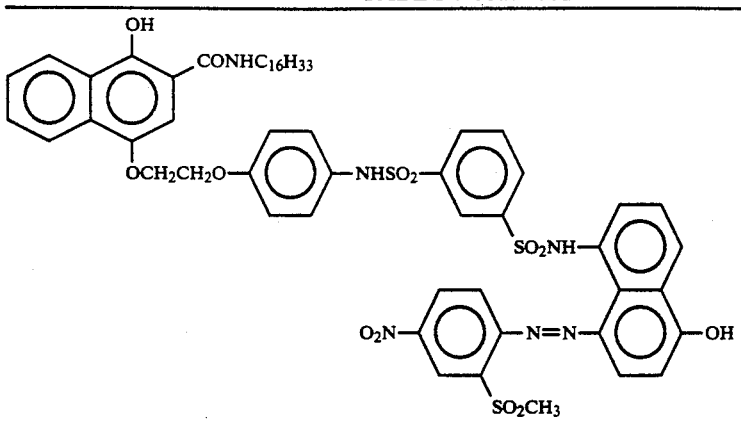

Photosensitive materials 202–204 which had the same structure as photosensitive material 201 except that compounds (I-4), (I-9) and (I-30) of this present invention were added in an amount equimolar with the development inhibitor releasing compound in the second and fourth layers in photosensitive material 201 were prepared.

The preparation of the dye fixing material (R-2) is described below.

Ten grams of poly(methyl methacrylate/N,N,N-trimethyl-N-vinylbenzylammonium chloride) (methyl acrylate/vinylbenzylammonium chloride ratio 1 1) was dissolved in 200 ml of water and mixed uniformly with 100 grams of 10% lime-treated gelatin. Film hardening agent was added to the mixed liquid and this was coated uniformly to provide a wet film thickness of 90 μm on a paper support which had been laminated with polyethylene in which titanium dioxide had been dispersed. This sample was dried and used as the dye fixing material (R-2) which had a mordant layer.

After exposure using a tungsten lamp through B, G, and R color separation filters, the photosensitive material was heated uniformly for 30 seconds on a heating block which had been heated to 150° C.

Water was supplied in an amount of 20 ml per square meter to the film surface side of the dye fixing material (R-2) and then the above-mentioned photosensitive material with which the heating treatment had been completed was laminated with the fixing material in such a way that the film surfaces were in contact with one another.

On peeling the two materials apart after passing the laminate which had subsequently been heated to 80° C. at a line speed of 12 mm/sec a negative image was obtained on the dye fixing material.

Next, (a) the magenta density on giving a yellow density of 1.0, (b) the cyan density on giving a magenta density of 1.0 and (c) the magenta density on giving a cyan density of 1.0 were measured and the degree of color turbidity was investigated. The results obtained are shown in Table 4

TABLE 4

| Photosensitive Material No. | Degree of Color Turbidity (a) | (b) | (c) |
|---|---|---|---|
| 201 (Comparative Example) | 0.39 | 0.34 | 0.48 |
| 202 (This Invention) | 0.25 | 0.23 | 0.30 |
| 203 (This Invention) | 0.23 | 0.21 | 0.28 |
| 204 (This Invention) | 0.23 | 0.22 | 0.30 |

It is clear from table 4 that color turbidity can be suppressed by using compounds of the present invention.

EXAMPLE 4

Photosensitive material 301 which had the layer structure shown in Table 5 below was prepared using the same emulsions, dye donating substances and electron donors etc. as in Example 1. Moreover, photosensitive material 302 was prepared by adding 0.03 grams and 0.02 gram of compound (I-4) of the present invention to the second and fourth layers respectively of photosensitive material 301.

TABLE 5

| Layer Number | Layer Name | Additive | Coated Weight (g/m$^2$) |
|---|---|---|---|
| Sixth Layer | Protective layer | Gelatin | 0.90 |
| | | Matting agent (silica) | 0.03 |
| | | Water soluble polymer (1)* | 0.02 |
| | | Surfactant (1)* | 0.06 |
| | | Surfactant (2)* | 0.13 |
| | | Film hardening agent (1)* | $6 \times 10^{-3}$ |
| Fifth Layer | Blue Sensitive Emulsion Layer | Emulsion (III) as silver | 0.38 |
| | | Gelatin | 0.56 |
| | | Anti-foggant (1)* | $3.0 \times 10^{-4}$ |
| | | Yellow dye donating compound (1)* | 0.40 |
| | | High boiling point organic solvent (1)* | 0.20 |
| | | Electron donor (1)* | 0.31 |
| | | Surfactant (3)* | 0.05 |
| | | Film hardening agent (1)* | $6 \times 10^{-3}$ |
| | | Water soluble polymer (1)* | 0.02 |
| Fourth Layer | Intermediate Layer | Gelatin | 0.70 |
| | | Reducing agent (1)* | 0.18 |
| | | Development inhibitor releasing compound (II-12) | 0.05 |
| | | HIgh boiling point solvent (1)* | 0.06 |

TABLE 5-continued

| Layer Number | Layer Name | Additive | Coated Weight (g/m²) |
|---|---|---|---|
| | | Surfactant (3)* | $8.2 \times 10^{-3}$ |
| | | Surfactant (1)* | 0.02 |
| | | Surfactant (4)* | 0.07 |
| | | Water soluble polymer (1)* | 0.02 |
| | | Film hardening agent (1)* | $6 \times 10^{-3}$ |
| Third Layer | Green Sensitive Emulsion Layer | Emulsion (II) as silver | 0.21 |
| | | Gelatin | 0.29 |
| | | Anti-foggant (1)* | $2.0 \times 10^{-4}$ |
| | | Magenta dye donating compound (2)* | 0.31 |
| | | High boiling point organic solvent (1)* | 0.16 |
| | | Electron donor (1)* | 0.17 |
| | | Surfactant (3)* | 0.04 |
| | | Film hardening agent (1)* | $6 \times 10^{-3}$ |
| | | Water soluble polymer (1)* | 0.02 |
| Second Layer | Intermediate Layer | Gelatin | 0.80 |
| | | Reducing agent (1)* | 0.18 |
| | | Development inhibitor releasing compound (II-12) | 0.05 |
| | | High boiling point solvent (1)* | 0.06 |
| | | Surfactant (3)* | $8.2 \times 10^{-3}$ |
| | | Surfactant (1)* | 0.06 |
| | | Surfactant (4)* | 0.10 |
| | | Active carbon | 0.03 |
| | | Water soluble polymer (1)* | 0.03 |
| | | Film hardening agent (1)* | $6 \times 10^{-3}$ |
| First Layer | Red Sensitive Emulsion Layer | Emulsion (I) as silver | 0.22 |
| | | Gelatin | 0.30 |
| | | Anti-foggant (1)* | $2.0 \times 10^{-4}$ |
| | | Cyan dye donating compound (3)* | 0.39 |
| | | High boiling point organic solvent (1)* | 0.19 |
| | | Electron donor (1)* | 0.19 |
| | | Surfactant (3)* | 0.04 |
| | | Film hardening agent (1)* | $6 \times 10^{-3}$ |
| | | Water soluble polymer (1)* | 0.02 |
| | | Support (Poly(ethylene terephthalate), Thickness 100μ) | |
| Backing Layer | | Carbon black | 0.44 |
| | | Polyester | 0.30 |
| | | Poly(vinyl chloride) | 0.30 |

A dye fixing material was prepared in the way described below.

Paper Support

Polyethylene (30 μm) was laminated in both sides of a paper of thickness 150 μm. Ten percent by weight with respect to the polyethylene of titanium oxide was dispersed in the polyethylene on the image receiving layer side.

Back Side (a) A light shielding layer of 4.0 g/m² of carbon black and 2.0 g/m² of gelatin.

(b) A white layer of 8.0 g/m² of titanium oxide and 1.0 g/m² of gelatin.

(c) A protective layer of 0.6 g/m² of gelatin.

These were established in the order (a)-(c) by coating and hardened with a film hardening agent.

Image Receiving Layer Side (1) A neutralizing layer containing 22 g/m² of an acrylic acid/butyl acrylate (mol ratio 8:2) copolymer of average molecular weight 50,000.

(2) A second timing layer containing a total of 4.5 g/m² of cellulose acetate of 51.3% acetylation (of which the weight of acetic acid liberated on hydrolysis was 0.513 grams per gram of sample) and a styrene/maleic anhydride (mol ratio 1:1) copolymer of average molecular weight about 10,000 in the proportions by weight of 95 to 5.

(3) An intermediate layer containing 0.4 grams of poly(2-hydroxyethyl acrylate).

(4) A first timing layer containing 1.6 g/m² as solid fraction of a blend in the proportions as solid fractions of 6 to 1 of a polymer latex obtained by the emulsion polymerization in the ratio by weight of 49.7/42.3/4/4 or styrene/butyl acrylate/acrylic acid/N-methylolacrylamide and a polymer latex obtained by the emulsion polymerization in the proportions by weight of 93 to 3 to 4 of methyl methacrylate/acrylic acid/N-methylolacrylamide.

(5) An image receiving layer established by coating 30.0 g/m² of a polymer mordant which had repeating units as indicated below and 3.0 g/m² of gelatin, using the surfactant with n=30 indicated below as a surfactant.

polymer mordant

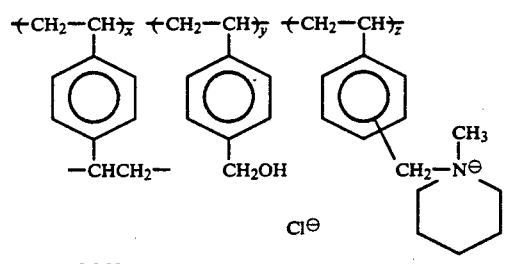

x:y:z = 5:5:90 surfactant

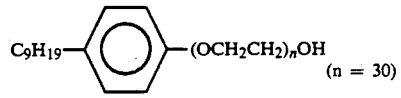

(6) A protective layer established by coating 0.6 g/m$^2$ of gelatin.

The layers (1) to (6) indicated above were established sequentially by coating and the film was hardened with a film hardening agent.

The formulation of the developer is indicated below.

| | |
|---|---|
| 1-p-Tolyl-4-hydroxymethyl-4-methyl-3-pyrazolidone | 8.0 grams |
| 1-Phenyl-4-hydroxymethyl-4-methyl-3-pyrazolidone | 2.0 grams |
| Sodium sulfite (anhydrous) | 2.0 grams |
| Hydroxyethylcellulose | 40 grams |
| Potassium hydroxide | 56 grams |
| Benzyl alcohol | 2.0 grams |
| Water to make up to a total weight of | 1 kg |

The aforementioned photosensitive material was exposed from the emulsion layer side through Y, M, C and gray color separation filters and then this was laminated on the image receiving layer side of the dye fixing material and the above mentioned developer was spread by means of pressure rollers to a thickness of 65 μm between the two materials. Processing was carried out at 25° C. and the dye fixing material was peeled away from the photosensitive material after 1.5 minutes.

Next, (a) the magenta density on giving a yellow density of 1.0, (b) the cyan density on giving a magenta density of 1.0 and (c) the magenta density on giving a cyan density of 1.0 of the positive images obtained on the dye fixing material were measured and the degree of color turbidity was investigated. The results obtained are shown in Table 6.

TABLE 6

| Photosensitive Material No. | Degree of Color Turbidity (a) | (b) | (c) |
|---|---|---|---|
| 301 (Comparative Example) | 0.30 | 0.39 | 0.29 |
| 302 (This Invention) | 0.24 | 0.28 | 0.26 |

It is clear from the above results that color turbidity can be reduced and that color reproduction can be improved by using compounds of this present invention.

While the invention has been described in detail and with reference to specific embodiments thereof, it will be apparent to one skilled in the art that various changes and modifications can be made therein without departing from the spirit and scope thereof.

What is claimed is:

1. A diffusion transfer-type silver halide color photographic photosensitive thermally developable material comprising a support, having thereon at least a photosensitive silver halide, a binder, a reducible and diffusible dye donating compound which reacts with reducing agents which remain unoxidized upon development and releases a diffusible dye, a development inhibitor releasing compound which releases a development inhibitor, and a compound represented by Formula (I):

$$R^1—Y—O—H \qquad (I)$$

wherein $R^1$ represents an alkyl group, an aryl group, an alkylamino group, an arylamino group, an alkoxy group, an aryloxy group, a heterocyclic residual group, or a polymer residual group of said groups, Y represents

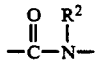

or —$SO_2$—$NR^2$—, $R^2$ represents a hydrogen atom, an alkyl group, an aryl group or an acyl group, an $R^1$ and $R^2$ may be joined together to form a five to eight membered ring.

2. The material of claim 1, wherein Y is

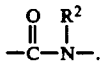

3. The material of claim 1, wherein $R^1$ is an alkyl group, an aryl group or a heterocyclic residual group.

4. The material of claim 1, wherein $R^2$ is an alkyl group or an aryl group.

5. The material of claim 1, wherein said compound of formula (I) is selected from the group consisting of compounds I-1 thru I-38:

| | Compound |
|---|---|
| I-1 | 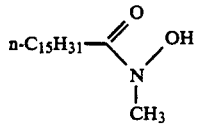 |
| I-2 | 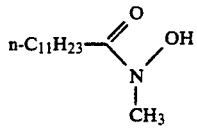 |
| I-3 | 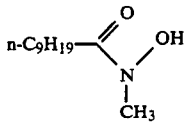 |
| I-4 | 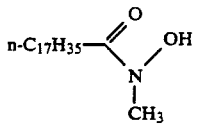 |
| I-5 | 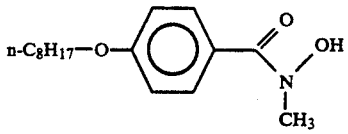 |
| I-6 | 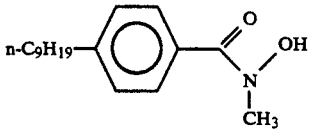 |
| I-7 | 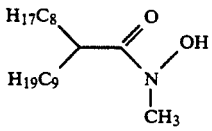 |

-continued
| Compound | |
|---|---|
| I-8 | 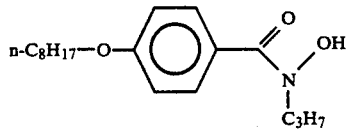 |
| I-9 | 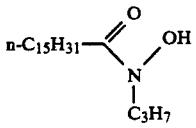 |
| I-10 | 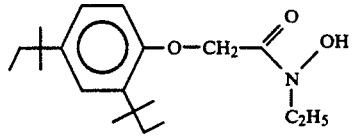 |
| I-11 | 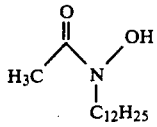 |
| I-12 | 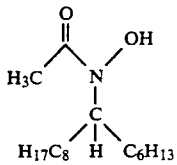 |
| I-13 | 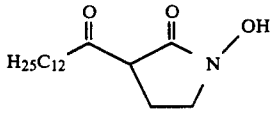 |
| I-14 | 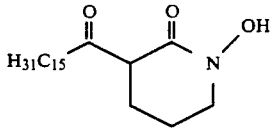 |
| I-15 | 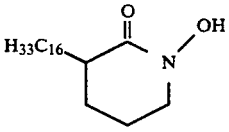 |
| I-16 | 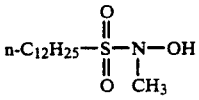 |
| I-17 | 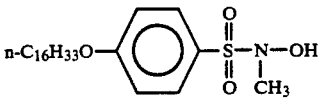 |
| I-18 | 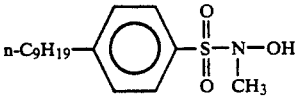 |
-continued
| Compound | |
|---|---|
| I-19 | 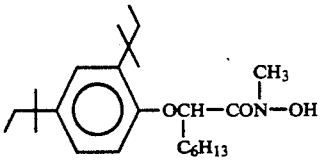 |
| I-20 | 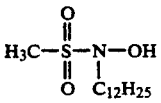 |
| I-21 | 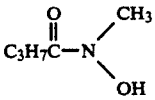 |
| I-22 | 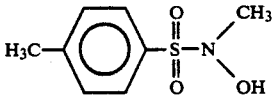 |
| I-23 | 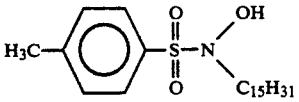 |
| I-24 | 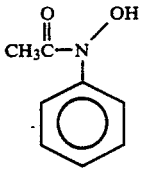 |
| I-25 | 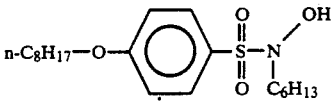 |
| I-26 | 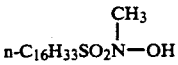 |
| I-27 | 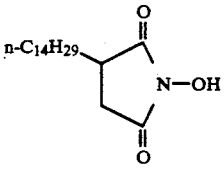 |
| I-28 | 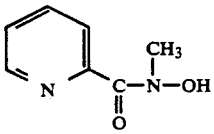 |
| I-29 | 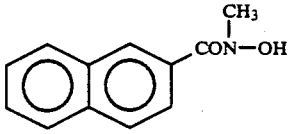 |

-continued

| | Compound |
|---|---|
| I-30 | 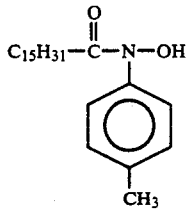 |
| I-31 | 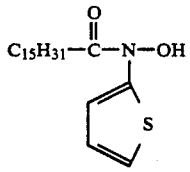 |
| I-32 | 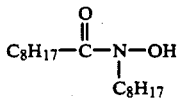 |
| I-33 | 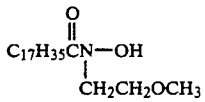 |
| I-34 | 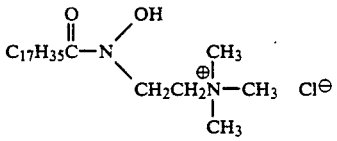 |
| I-35 | 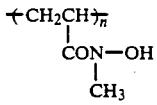 (n = 10~10,000) |
| I-36 | 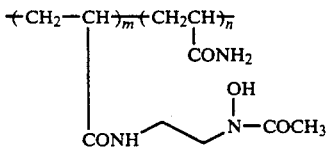 m and n represent 20 to 10,000 |

-continued

| | Compound |
|---|---|
| I-37 | 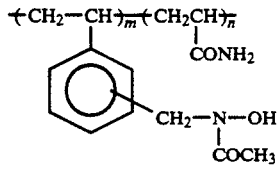 m and n are as defined above |
| I-38 | 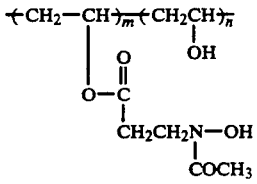 m and n are as defined above . |

6. The material of claim 1, wherein said compound of formula (I) is added to a separate layer from a layer comprising said dye donating compound.

7. The material of claim 1, wherein the amount of said compound of formula (I) is 0.001-5 mol per mole of said silver halide.

8. The material of claim 7, wherein said amount is 0.01-1.5 mol.per mole of said silver halide.

9. The material of claim 1, wherein the amount of said compound of formula (I) is 0.005-10 mol per mole of said dye donating compound which forms or releases a diffusible dye.

10. The material of claim 9, wherein said amount is 0.02-1 mol per mole of said dye donating compound which forms or releases a diffusible dye.

11. The material of claim 1, wherein said compound of formula (I) is added in the amount of 0.01-100 mol per mole of said development inhibitor releasing compound.

12. The material of claim 11, wherein said amount is 0.1-20 mol per mole of said development inhibitor releasing compound.

13. The material of claim 1, wherein said development inhibitor releasing compound is selected from the group consisting of compounds II-1 thru II-8 and II-10 thru II-20:

II-1

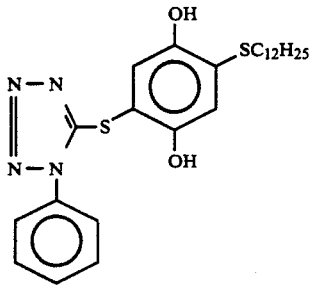

II-2

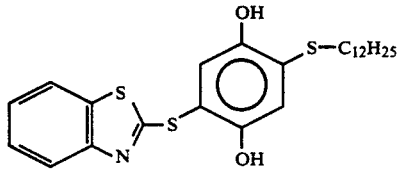

-continued
II-3
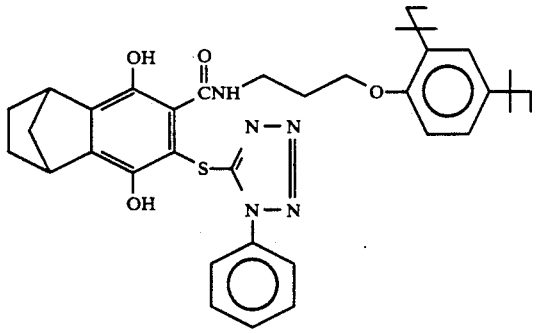
II-4
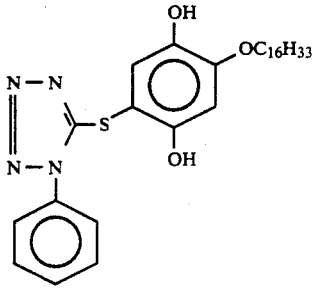
II-5
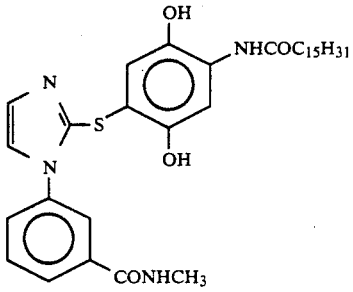
II-6
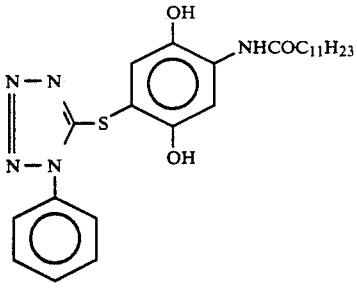
II-7
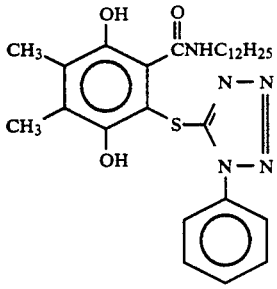

-continued
II-8
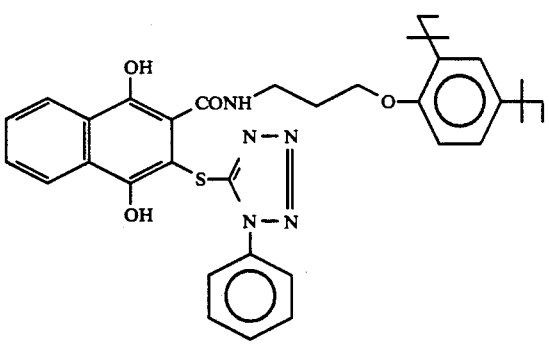
II-10
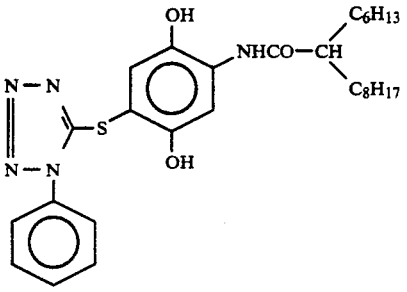
II-11
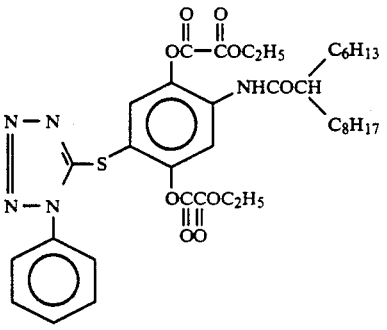
II-12
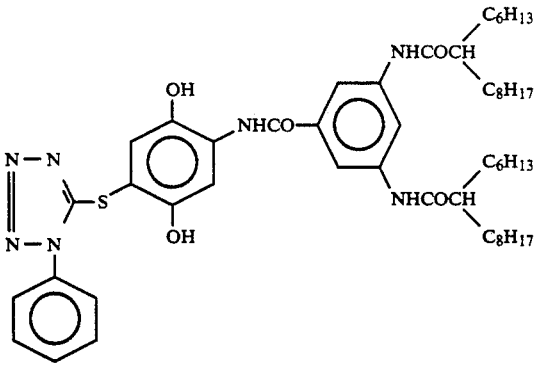
II-13
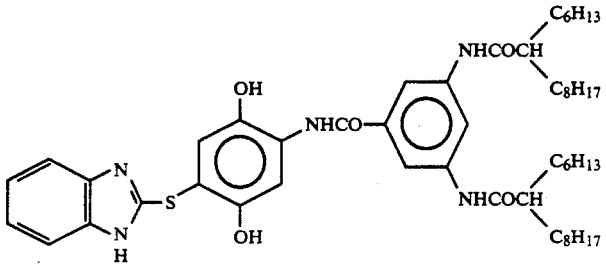

-continued
II-14
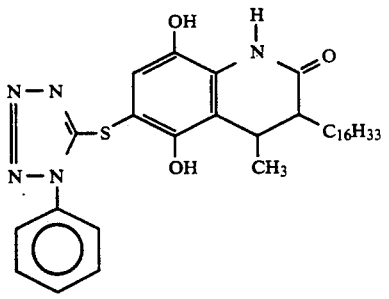
II-15
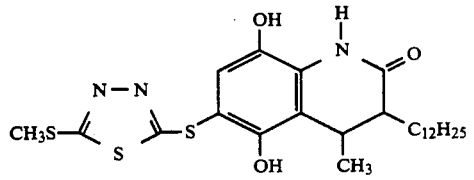
II-16
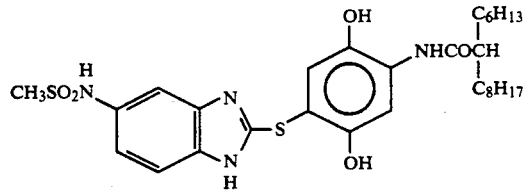
II-17
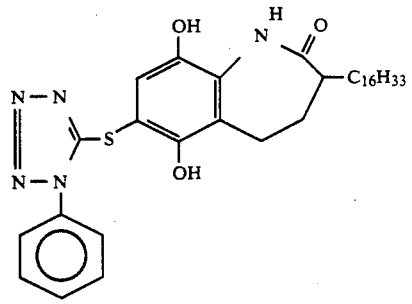
II-18
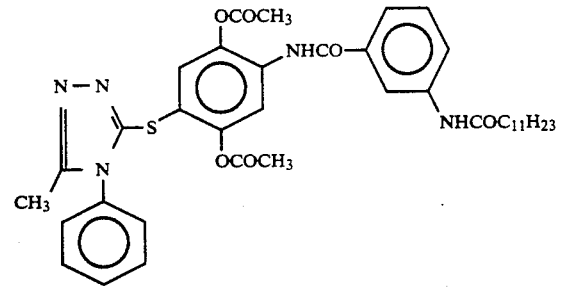
II-19
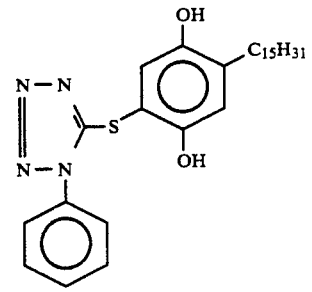

-continued

II-20

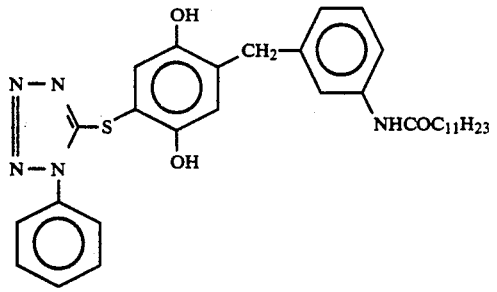

14. The material of claim 1, wherein said compound of formula (I) is added to an intermediate layer in which the development inhibitor releasing compound in added.

15. The material of claim 14, wherein said compound of formula (I) is added in the amount of 0.01-100 mol per of said development inhibitor releasing compound.

16. The material of claim 15, wherein said amount is 0.1-20 mol per of said development inhibitor releasing compound.

17. The material of claim 1, wherein the development inhibitor releasing compound is a development inhibitor releasing hydroquinone compound.

* * * * *